US007451729B2

(12) United States Patent
Sugiura et al.

(10) Patent No.: US 7,451,729 B2
(45) Date of Patent: Nov. 18, 2008

(54) VARIABLE VALVE MECHANISM

(75) Inventors: Akira Sugiura, Nishio (JP); Tetsuya Niwa, Nishio (JP); Tamotsu Yamamoto, Nishio (JP); Katsutoshi Kitagawa, Nishio (JP); Tomiyasu Hirano, Nishio (JP); Tomoki Miyoshi, Nishio (JP)

(73) Assignee: Otics Corporation, Aichi-ken (JP)

( * ) Notice: Subject to any disclaimer, the term of this patent is extended or adjusted under 35 U.S.C. 154(b) by 0 days.

(21) Appl. No.: 11/716,745

(22) Filed: Mar. 12, 2007

(65) Prior Publication Data

US 2007/0295292 A1 Dec. 27, 2007

(30) Foreign Application Priority Data

Jun. 27, 2006 (JP) ..... 2006-177356

(51) Int. Cl.
*F01L 1/34* (2006.01)

(52) U.S. Cl. ..... 123/90.16; 123/90.15; 123/90.31

(58) Field of Classification Search ..... 123/90.16, 123/90.15, 90.17, 90.31
See application file for complete search history.

(56) References Cited

U.S. PATENT DOCUMENTS 6,497,206 B2 * 12/2002 Nohara et al. ..... 123/90.16

FOREIGN PATENT DOCUMENTS

| | | |
|---|---|---|
| EP | 1 357 266 | 10/2003 |
| EP | 1 801 368 | 6/2007 |
| JP | 11-324625 | 11/1999 |
| JP | 2002-371816 | 12/2002 |
| WO | WO 03/008772 | 1/2003 |

OTHER PUBLICATIONS

European Search Report dated Oct. 25, 2007.

* cited by examiner

*Primary Examiner*—Zelalem Eshete
(74) *Attorney, Agent, or Firm*—McGinn IP Law Group, PLLC

(57) ABSTRACT

The present invention provides a variable valve mechanism which includes a rotating cam provided on a camshaft, a swing arm that contacts with the rotating cam to swing, a drive arm that drives a valve in conjunction with the swing arm, a variable arm that turns the drive arm around a swing axis of the swing arm, an actuator that drives the variable arm, and cam device that is provided between the swing arm and the drive arm. The variable arm is provided so as to be able to rotate relatively around the same axis as the swing arm, and the cam device changes the initial position of the drive arm with respect to the swing arm accompanying the turning of the drive arm.

16 Claims, 25 Drawing Sheets

VARIABLE VALVE MECHANISM

TECHNICAL FIELD

The present invention relates to a variable valve mechanism that controls the valve characteristics depending on the operating conditions of an internal combustion engine.

BACKGROUND OF THE INVENTION

Conventionally, a variable valve mechanism is known in which the lift amount, the working angle, and the open/close timing of the valve are controlled by using links. For example, the variable valve mechanism 200 in Japanese Patent Application Publication No. JP-A-11-324625, shown in FIG. 25, is provided with a camshaft 201 that is rotated by the crankshaft of an internal combustion engine. A rotating cam 202 is fastened to the camshaft 201 so as to rotate integrally therewith, and at the same time, a drive arm 204 that drives a valve 210 via a valve lifter 203 is supported so as to be able to rotate relatively thereto.

A swing arm 206 is supported by a variable cam 207 on a control shaft 205 that is parallel to the camshaft 201. The input end of the swing arm 206 is linked to the rotating cam 202 via a ring-shaped link 208, and the output end of the swing arm 206 is linked to the drive arm 204 via a rod-shaped link 209. In addition, the control shaft 205 is driven by an actuator, the swing arm 206 is shifted due to the eccentric rotation of the variable cam 207, and the initial position of the drive arm 204 with respect to the rotating cam 202 thereby changes.

SUMMARY OF THE INVENTION

However, according to this conventional variable valve mechanism 200, when the initial position of the drive arm 204 is changed, the variable cam 207 shifts the swing arm 206, and thus it is necessary to connect both with the ring-shaped link 208 in order to break off the power transmission from the swing arm 206 to the rotating cam 202. Thus, there are problems in that the number of parts of the variable valve mechanism 200 increases, and not only is the structure made more complex, but the valve characteristics may become unstable due to assembly errors.

An object of the present invention is to solve the problems described above and to provide a variable valve mechanism in which the number of parts is small, the structure is simple, and stable valve characteristics can be obtained.

In order to solve the problems described above, the variable valve mechanism of the present invention is provided with a rotating cam that is provided on a camshaft, a swing arm that contacts with the rotating cam to swing, a drive arm that directly or indirectly drives a valve in conjunction with the swing arm, a variable arm that turns the drive arm around a swing axis of the swing arm, an actuator that drives the variable arm, and a cam device that is provided between the swing arm and the drive arm, and wherein the variable arm is provided so as to be able to rotate relatively around the same axis as the swing arm, and the cam device changes the initial position of the drive arm with respect to the swing arm accompanying the turning of the drive arm.

Here, the following constitutions may be used for the drive arm.

(1) The proximal end of the drive arm is linked to the variable arm, a valve drive portion is provided at the distal end of the drive arm, and the cam device is provided between the middle portion of the drive arm and the swing arm.

(2) The proximal end of the drive arm is linked to the variable arm, the cam device is provided between the distal end of the drive arm and the swing arm, and a valve drive portion is provided at the middle portion of the drive arm.

The following constitutions are may be used for the cam device.

(3) The cam device is structured by a cam surface that is formed on the swing arm and a cam follower that is supported by the drive arm.

(4) The cam device is structured by a cam follower that is supported by the swing arm and a cam surface that is formed on the drive arm.

The following constitutions may be used as the drive system of the variable arm.

(5) The variable arm and the swing arm are supported so as to be able to rotate relatively to each other on a common control shaft, the control shaft is linked to the actuator, and the variable arm is driven via the control shaft by the actuator.

(6) The variable arm and the swing arm are supported so as to be able to rotate relatively to each other on a common support shaft, a control shaft that is separate from the support shaft is linked to the actuator, and the variable arm is driven via the control shaft by the actuator.

(7) The variable arm and the swing arm are supported so as to be able to rotate relatively to each other on a common support shaft, a control shaft that is separate from the support shaft is linked to the actuator, a control cam that drives the variable arm is provided on the control shaft, and a shim is interposed between the control cam and the variable arm.

The position at which the control shaft that is separate from the support shaft may be:

(8) on the side of the variable arm, (9) below the variable arm, or (10) above the variable arm.

In the present specification, "vertical" denotes an axial direction of a cylinder of an internal combustion engine (refer to the axis A in FIG. 20), "below" denotes a direction that approaches a cylinder, and "above" denotes a direction that separates from a cylinder. In addition, the "side" of a variable arm denotes a state in which the bottom end of the control shaft is positioned lower than the top end of the variable arm and the upper end of the control shaft is positioned higher than the bottom end of the variable arm. "Below" a variable arm denotes a state in which the upper end of the control shaft is positioned lower than the bottom end of the variable arm, and "below" a variable arm also includes below the side of the variable arm, as well as just immediately below the variable arm. "Above" a variable arm denotes the state in which the bottom end of the control shaft is positioned higher than the upper end of the variable arm, and "above" a variable arm also includes above the side of the variable arm, as well as just immediately above the variable arm.

As modes for the variable arm when the control shaft that is separate from the support shaft is provided at the side of the variable arm, the following may be used:

(11) The distal end of the variable arm is below the support shaft and the variable arm slants downward as a whole toward the distal end, and thus the variable arm has a slanted surface that slants downward toward the distal end.

(12) In proximity to the distal end of the variable arm, the variable arm has a slanted surface that slants downward toward the distal end.

As modes in which the control shaft that is separate from the support shaft is provided below the variable arm, the following may be used:

(13) The variable arm directly engages with the control cam via a linking pin.

(14) A transfer member is interposed between the control cam and the variable arm, and the transfer member is engaged by a linking pin to the control cam.

According to the variable valve mechanism of the present invention, because the variable arm is provided so as to be able to rotate relatively around the same axis as the swing arm, the power of the actuator that drives the variable arm is not transferred to the swing arm, and while the swing arm is held stationary, the initial position of the drive arm with respect to the swing arm can be accurately changed. Thus, it is possible to bring the swing arm directly into contact with the rotating cam without interposing a separate member such as a link, and therefore, the variable valve mechanism can be structured simply by a few parts, assembly errors can be reduced, and the valve characteristics can be made stable.

In addition, in the case in which a valve drive portion is provided at the distal end of the a drive arm and a cam device is provided between the middle portion of the drive arm and the swing arm, the arm ratio of the drive arm increases as the initial position of the drive arm is adjusted toward the low speed side. Thus, there are the effects that a large valve lift is obtained during a relatively short open timing and a lean burn during low speed operation can be stable.

In addition, in the case in which a shim is interposed between the control cam on the control shaft and the variable arm, by changing the thickness of the shim, it is possible to finely adjust the positions of the variable arm and the drive arm with respect to the swing arm. Thus, in an internal combustion engine that is provided with a plurality of cylinders, there is the effect that the variation in the valve characteristics between cylinders can be easily controlled even if the dimensional precision or the assembly precision of the valve train components is not strictly managed.

In addition, in the case in which a control shaft that is separate from the support shaft is provided on the side or below the variable arm, it is possible to lower the position of the control shaft, and the engine can be made more compact overall.

DETAILED DESCRIPTION OF THE INVENTION

Figure 1:
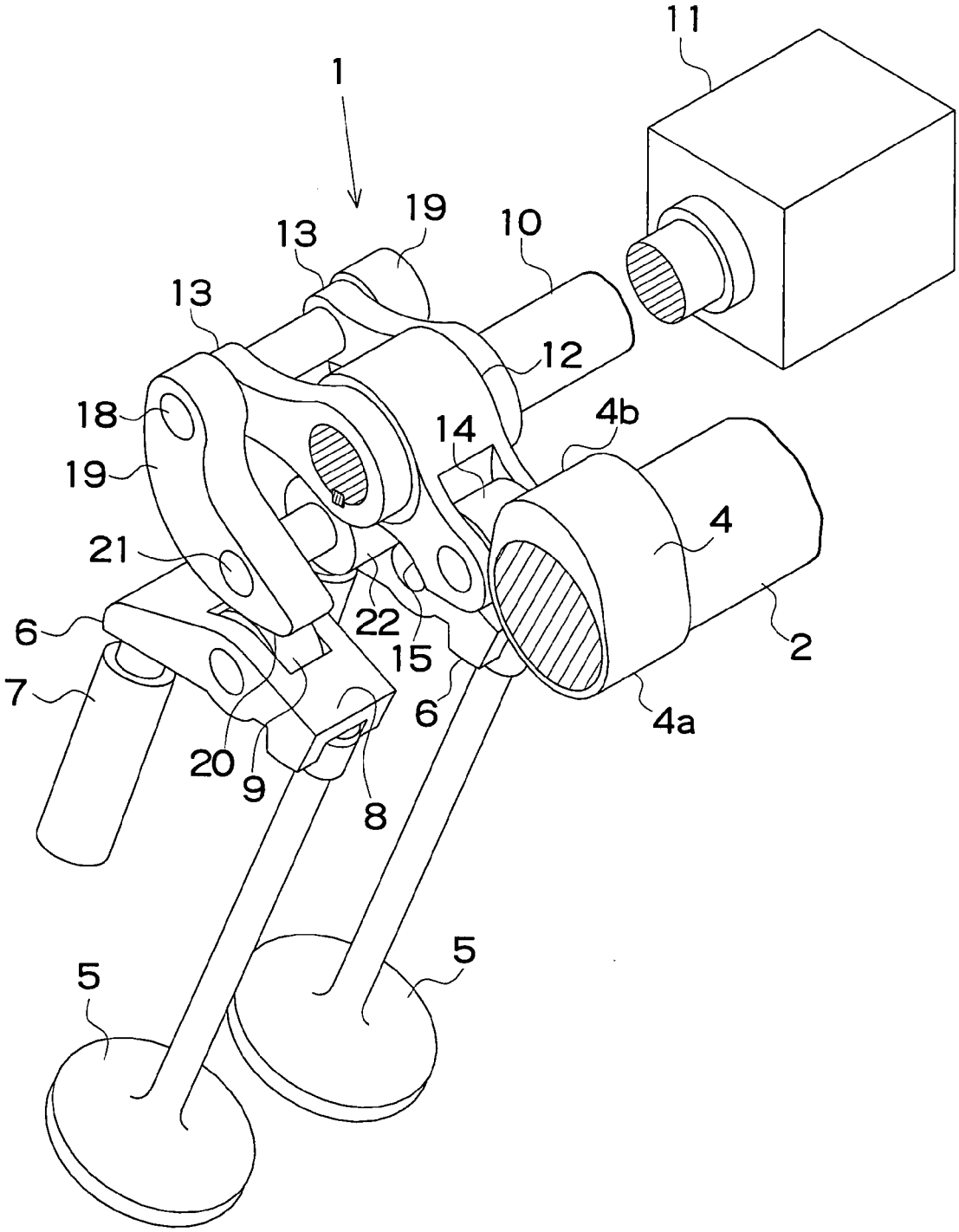
FIG. 1 is a perspective view of the variable valve mechanism according to a first embodiment of the present invention.

Below, embodiments of the present invention will be described with reference to the drawings. As shown in FIG. 1, the variable valve mechanism 1 of this embodiment is provided with a rotating cam 4 that is provided on a camshaft 2, a swing arm 12 that contacts with the rotating cam 4 to swing, a drive arm 19 that drives a valve 5 in conjunction with the swing arm 12, a variable arm 13 that turns the drive arm 19 around the swing axis of the swing arm 12, an actuator 11 that drives the variable arm 13, and a cam device that is provided between the swing arm 12 and the drive arm 19.

The swing arm 12 and the variable arm 13 are supported so as to be able to rotate relative to each other on a common control shaft 10. The proximal end of the drive arm 19 is linked to the variable arm 13, and the distal end of the drive arm 19 is provided with a drive portion 20 that drives the rocker arm 6. The cam device includes a cam surface 15 that is formed on the swing arm 12, and a cam follower 22 that is supported at the middle portion of the drive arm 19, and is structured such that the initial position of the drive arm 19 changes with respect to the swing arm 12 accompanying the turning of the drive arm 19.

Figure 2:
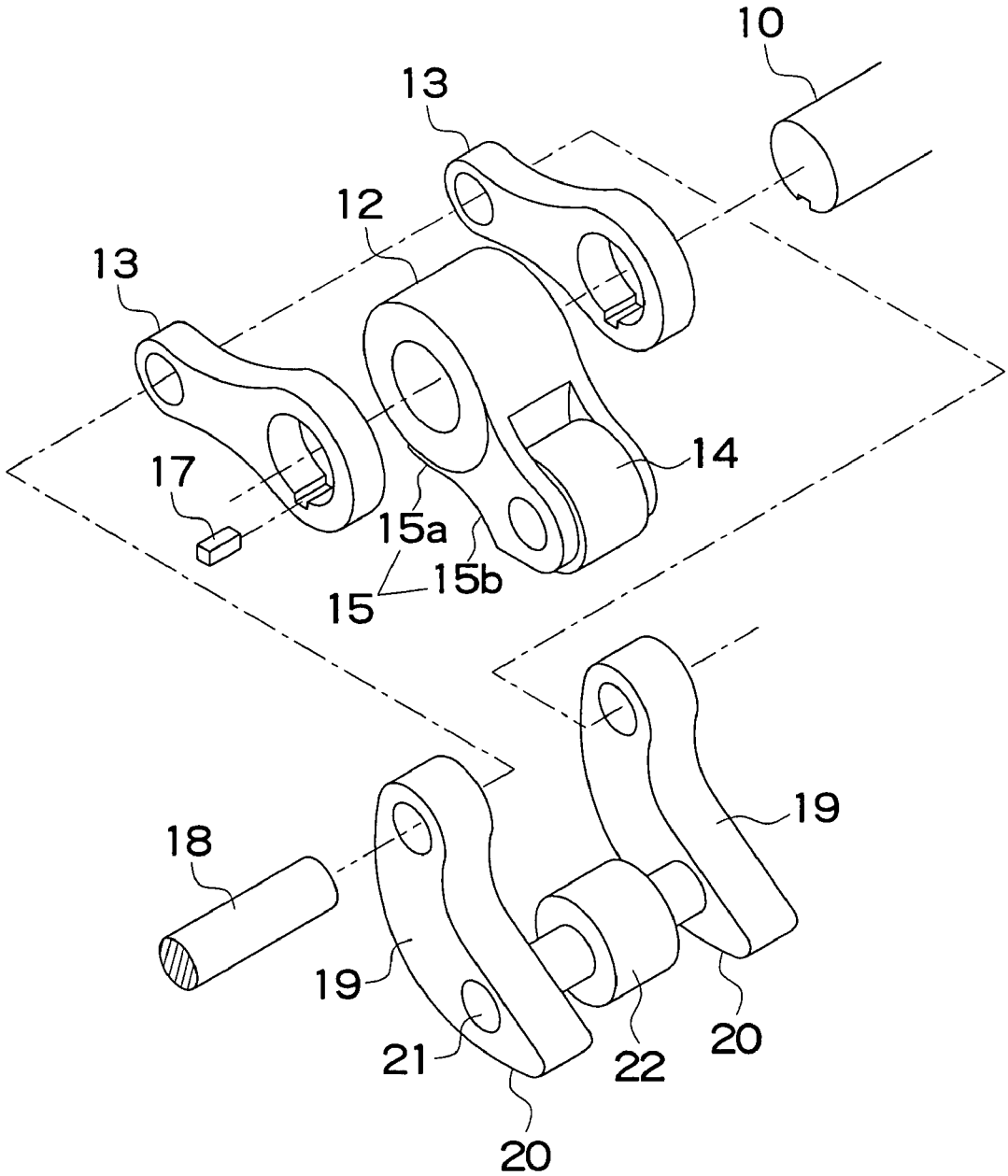
FIG. 2 is an exploded perspective view showing the essential components of the variable valve mechanism of the first embodiment.
Figure 3:
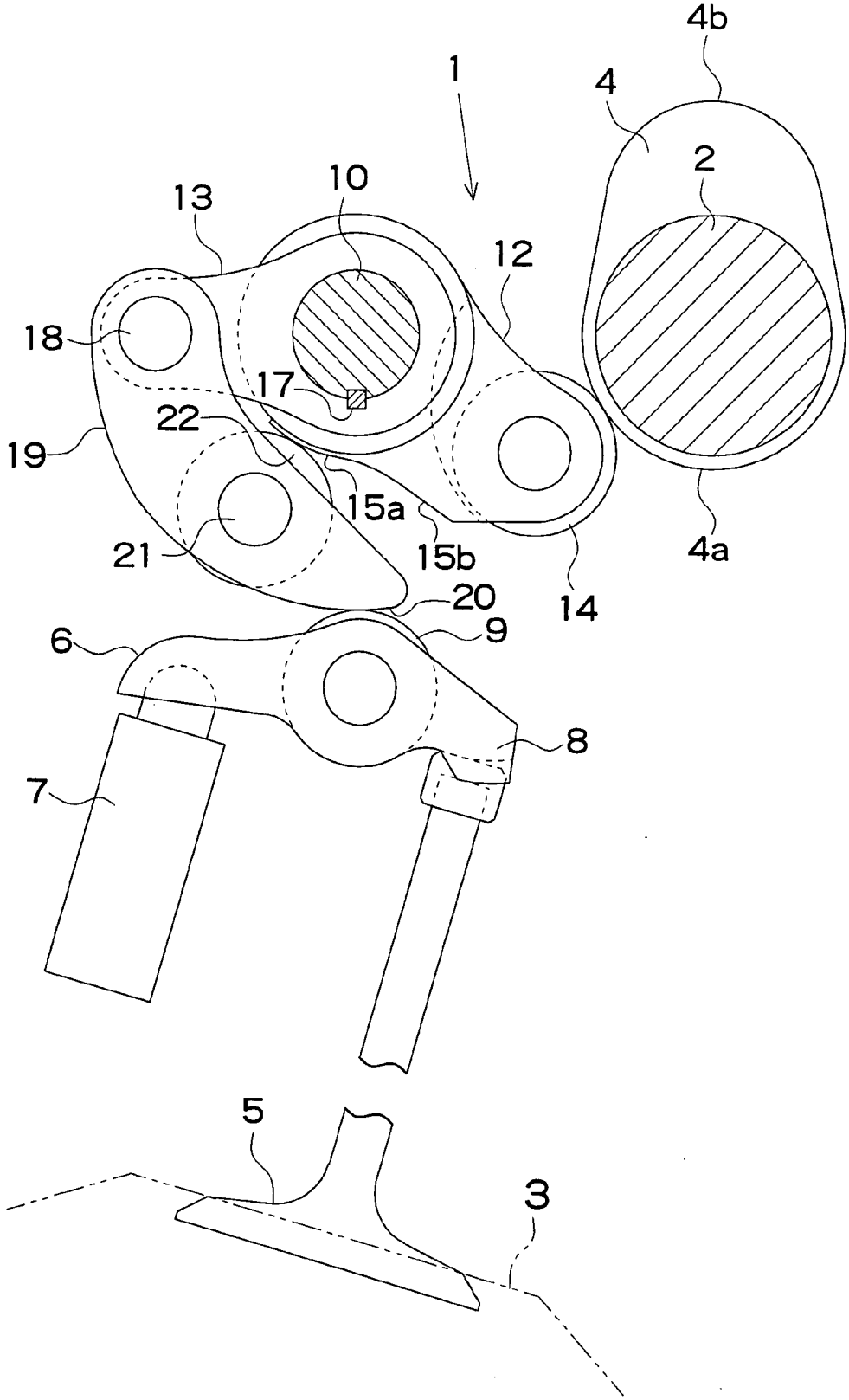
FIG. 3 is a cross-sectional view showing the variable valve mechanism of the first embodiment from the left side of FIG. 1.

A first embodiment of the present invention is shown in FIG. 1 to FIG. 6. This variable valve mechanism 1 is used in an intake system of a gasoline engine for an automobile. However, it is possible to apply the same mechanism to the exhaust system of a gasoline engine. As shown in FIG. 1 to FIG. 3, the camshaft 2 of the variable valve mechanism 1 is provided above a cylinder head 3, and is rotated by the crankshaft (not illustrated) of the engine. The rotating cam 4 is fastened on the camshaft 2, and the rocker arm 6 that opens and closes the valve (intake valve) 5 is disposed on the lower side of the camshaft 2.

Abase portion 4*a* that maintains the lift amount of a valve 5 at zero within a predetermined angular range and a nose portion 4*b* that increases valve lift amount within the remaining angular range are provided on the rotating cam 4. The rocker arm 6 is supported so as to rock vertically by a pivot 7 at the proximal end side, a pressing portion 8 that presses the upper end of the valve 5 is provided on the distal end, and the roller 9 is supported in the middle portion. Note that the variable valve mechanism 1 of this embodiment is structured such that, for one cylinder, one rotating cam 4 drives two rocker arms 6 to open and close two valves 5.

A control shaft 10 is provided parallel to the camshaft 2 above the rocker arms 6. The control shaft 10 is rotated by a hydraulic or an electrical actuator 11, and the actuator 11 is controlled by a control apparatus (not illustrated) depending on the operating state of the engine. One swing arm 12 is supported on the control shaft 10 so as to be able to swing, and an input roller 14 that contacts with the rotating cam 4 and a downward-facing cam surface 15 are provided on the swing arm 12. A constant radius portion 15*a* that is centered on the shaft center of the control shaft 10 and a lift portion 15*b* that projects from the constant radius portion 15*a* to the lower side are formed on the cam surface 15.

On the control shaft 10, two variable arms 13 are fastened by keys 17 on the both sides of the swing arm 12, and these are supported so as to be able to rotate integrally with the control shaft 10 with respect to the swing arm 12. The distal end portions of both variable arms 13 are joined by a rod 18, and the drive arms 19 are supported so as to be able to rotate on both ends of the rod 18. The proximal ends of these two drive arms 19 are linked to the variable arms 13 by the rod 18, and valve drive portions 20 that engage with the rollers 9 of the rocker arms 6 from above are formed on the distal ends of the drive arms 19. The middle portion of both drive arms 19 are linked by a linking shaft 21, and the cam follower 22, which contacts with the cam surface 15 of the swing arm 12, is supported on the linking shaft 21.

In addition, the drive arms 19 are turned around the shaft center of the control shaft 10 by the variable arms 13, the contact point position between the cam surface 15 and the cam follower 22 is changed accompanying the turning of the drive arms 19, and the initial position of the drive arms 19 thereby changes with respect to the swing arm 12. Note that the valve drive portion 20 of the drive arm 19 are included in the cylindrical surface concentric to the constant radius portion 15*a* of the cam surface 15. FIG. 1 and FIG. 2 show a structure in which one swing arm 12 is assembled on two drive arms 19, but the two swing arms 12 may be assembled separately on two drive arms 19.

Figure 4B:
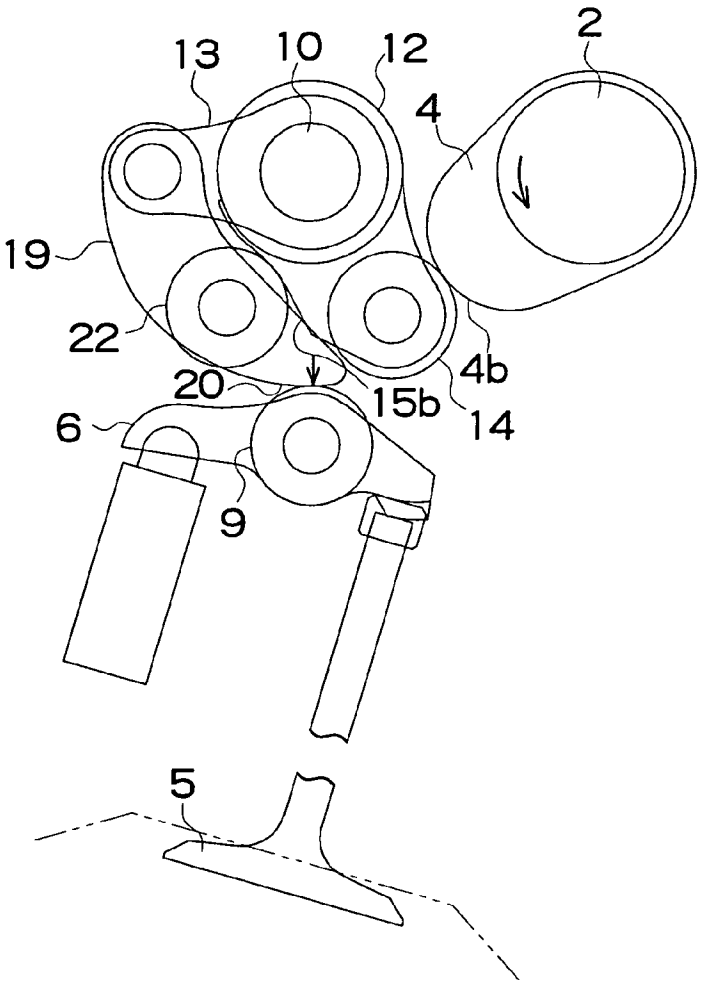
FIGS. 4A and 4B show structural diagrams showing the operation when the valve lift amount is minimized in the variable valve mechanism of the first embodiment.
Figure 4A:
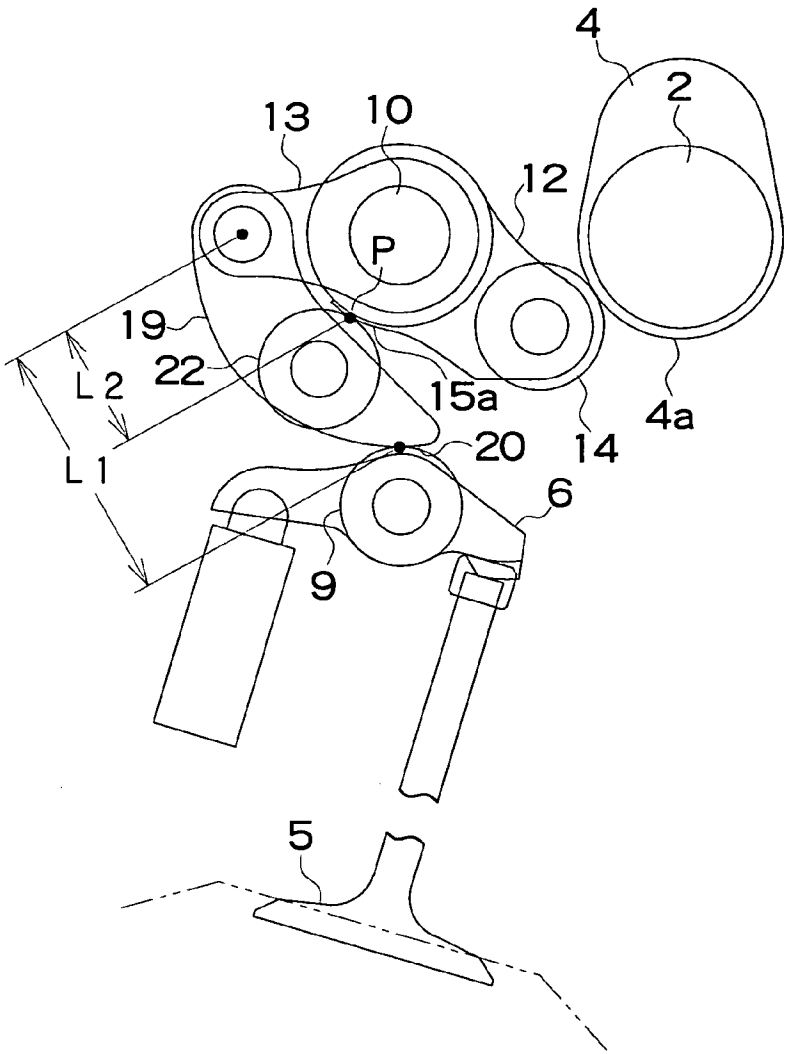

Next, the operation of the variable valve mechanism 1 will be described with reference to FIGS. 4 to 6. FIGS. 4A and 4B show the state when the valves 5 are opened and closed by the minimum lift amount. Here, as shown in FIG. 4A, the cam follower 22 is in contact with the leading edge of the constant radius portion 15*a* at the cam surface 15 of the swing arm 12 (P denotes the initial contact point position). In this state, when the camshaft 2 is driven, while the base portion 4*a* of the rotating cam 4 is engaged with the input roller 14 of the swing arm 12, due to the cam operation of the constant radius portion 15*a*, the swing arm 12, the drive arms 19, and the rocker arms 6 are all stationary, and the valves 5 are maintained in a closed position.

As shown in FIG. 4B, when the apex of the nose portion 4*b* is engaged with the input roller 14, the swing arm 12 swings downward, the lift portion 15*b* of the cam surface 15 rotates the drive arms 19 via the cam follower 22, and the valve drive portions 20 of the drive arms 19 press the rollers 9 of the rocker arms 6 downward. However, because the initial contact point position P is set at the leading edge side of the constant radius portion 15*a*, the operating range of the lift portion 15*b* is limited, and the rocker arms 6 rock by the minimum angle. Therefore, as shown by the curve A in FIG. 6, the valve lift amount and the working angle are both minimized, and the open timing of the intake valve 5 is controlled so as to be slow and the close timing thereof is controlled so as to be fast. Note that the curve E in FIG. 6 shows the lift amount and the working angle of an exhaust valve.

Figure 5B:
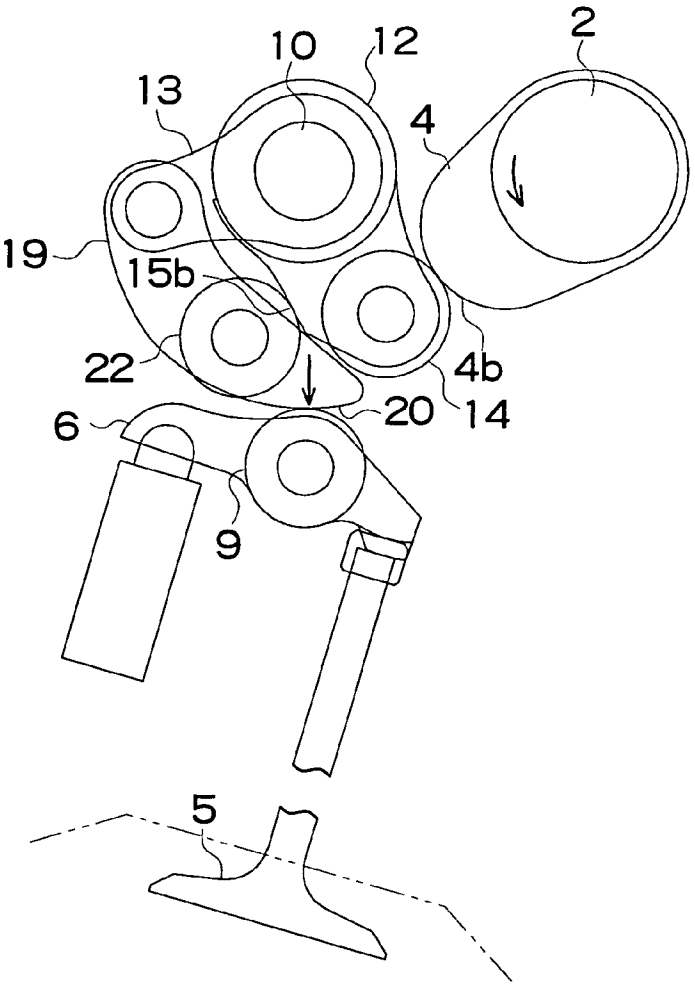
FIGS. 5A and 5B show structural diagrams showing the operation when the valve lift amount is maximized in the variable valve mechanism of the first embodiment.
Figure 5A:
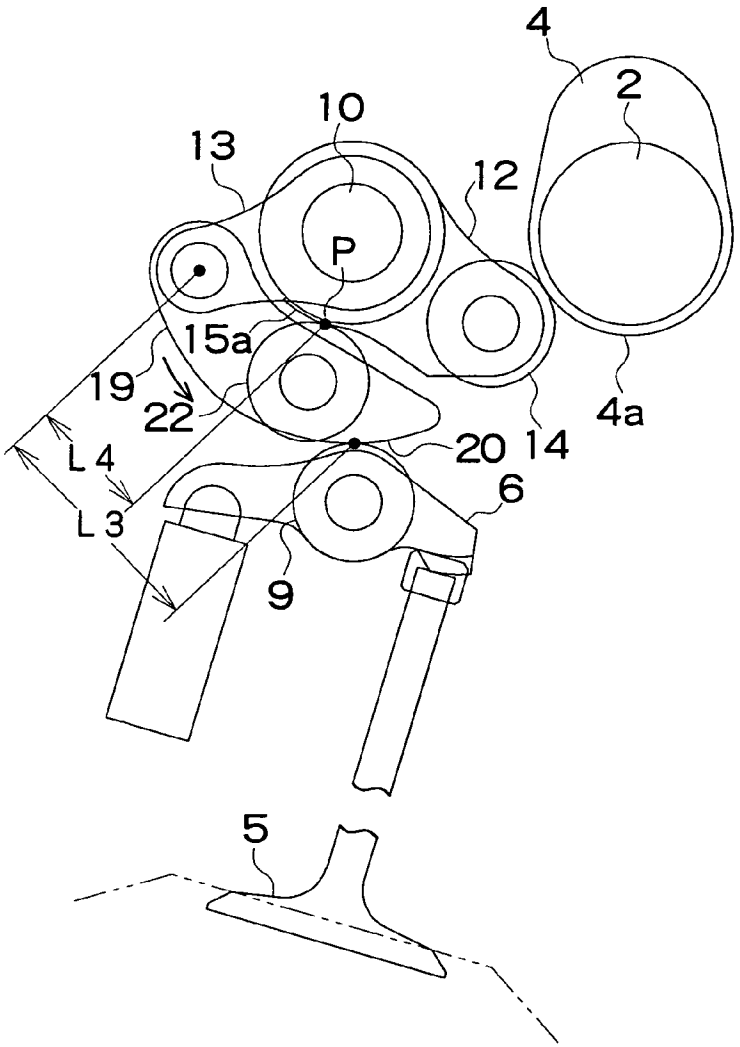
Figure 6:
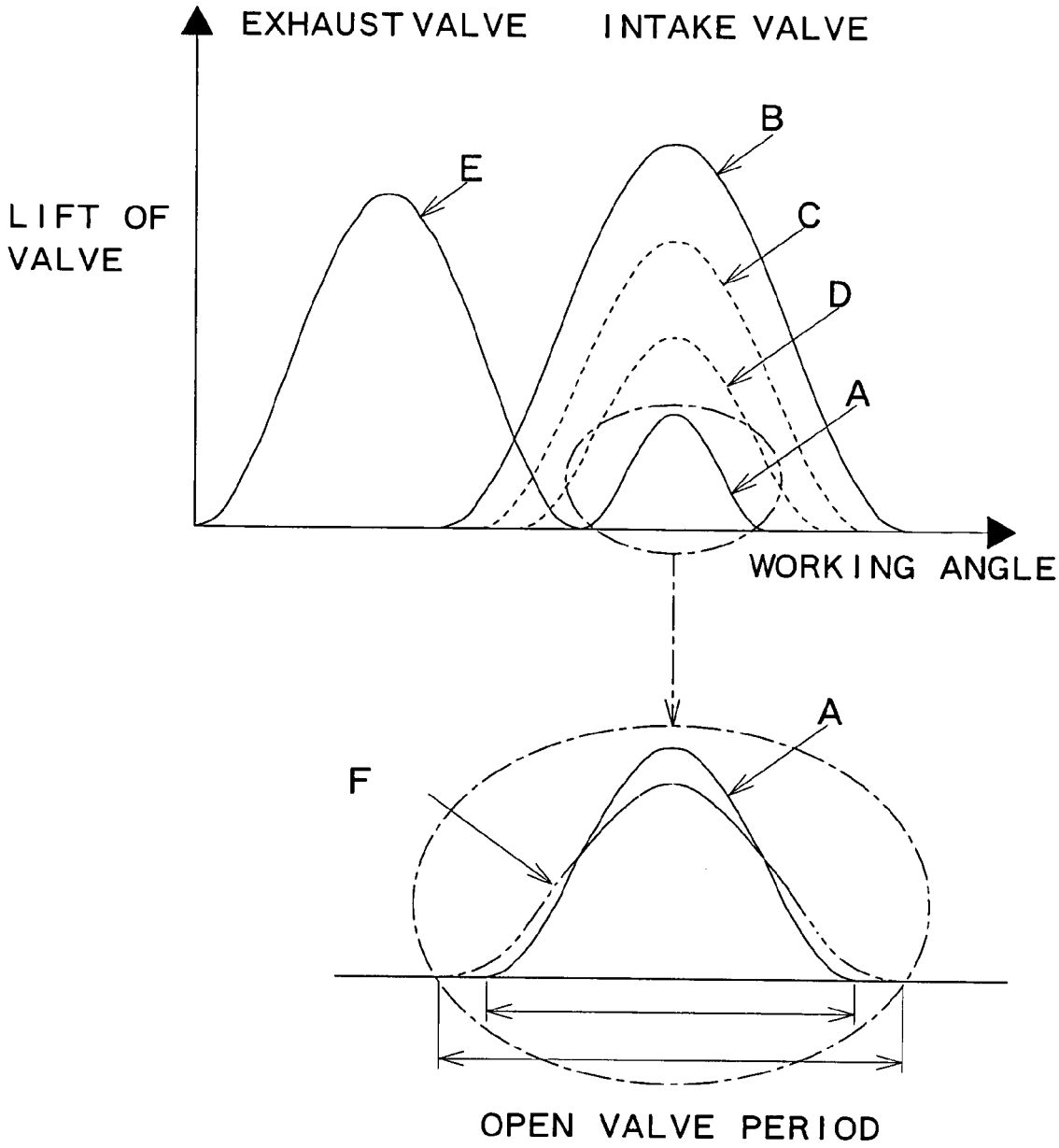
FIG. 6 is a characteristic diagram showing the relationship between the valve lift amount and the working angle.

FIGS. 5A and 5B show the state when the valves 5 are opened and closed by the maximum lift amount. As shown in FIG. 5A, the variable arms 13 turn the drive arms 19 around the swing axis of the swing arm 12 (around the shaft center of the control shaft 10), and bring the cam follower 22 into contact with the trailing edge side of the constant radius portion 15*a*. At this time, because the valve drive portions 20 of the drive arms 19 are formed concentrically with the constant radius portion 15*a*, the initial phase of the rocker arms 6 does not change accompanying the turning of the drive arms 19. Thus, while the base portion 4*a* is engaged with the input roller 14, the swing arm 12 and the rocker arms 6 are both stationary, and the valves 5 are maintained in the closed position.

As shown in FIG. 5B, when the apex of the nose portion 4*b* is engaged with the input roller 14, the swing arm 12 swings downward, the lift portion 15*b* contacts with the cam follower 22, and the valve drive portions 20 press the rocker arms 6 downward via the rollers 9. At this time, because the initial contact point position P changes to the trailing edge side of the constant radius portion 15*a*, the operating range of the lift portion 15*b* is widened, and the rocker arms 6 rock by the maximum angle. Thus, as shown by the curve B in FIG. 6, the valve lift amount and the working angle are both maximized, and the open timing of the intake valve 5 is controlled so as to be fast, and the close timing thereof is controlled so as to be slow. Therefore, the drive arms 19 are turned by the variable arms 13 and the initial contact point position P of the cam surface 15 and the cam follower 22 is changed. Thereby, as shown by the curves C and D in FIG. 6, the valve characteristic can be controlled so as to attain an arbitrary intermediate value.

In this connection, according to the variable valve mechanism 1 of the first embodiment, because the swing arm 12 and the variable arms 13 are supported so as to be able to rotate relative to each other on the control shaft 10, when the initial contact point position P is changed, the drive force of the actuator 11 is not transferred to the swing arm 12. Thus, while the swing arm 12 is held stationary, the drive arms 19 can be turned around the swing axis of the swing arm 12 by the variable arms 13. Therefore, it is possible to bring the swing arm 12 into direct contact with the rotating cam 4, without the intervention of a link member as is the case conventionally, and thus, the variable valve mechanism 1 can be structured simply by a few components, assembly errors are reduced, and it is possible to change the valve characteristics with a normally stable precision.

In addition, in this variable valve mechanism 1, because the drive arms 19 are provided with a cam follower 22 more toward the proximal end side than the valve drive portions 20, the arm ratio of the drive arms 19 increases as the initial contact point position P is adjusted toward the leading edge side (low speed side) of the constant radius portion 15*a* (L1/L2 in FIG. 4A>L3/L4 in FIG. 5A). Thus, in the valve characteristics during low speed rotation (at the curve A in FIG. 6), the value of the valve lift amount/working angle can be made higher in comparison to a conventional technology (curve F). Therefore, it is possible to open the valve 5 widely during a comparatively short open valve period (working angle width), and stabilize a lean burn during slow speed operation.

SECOND EMBODIMENT

Figure 7:
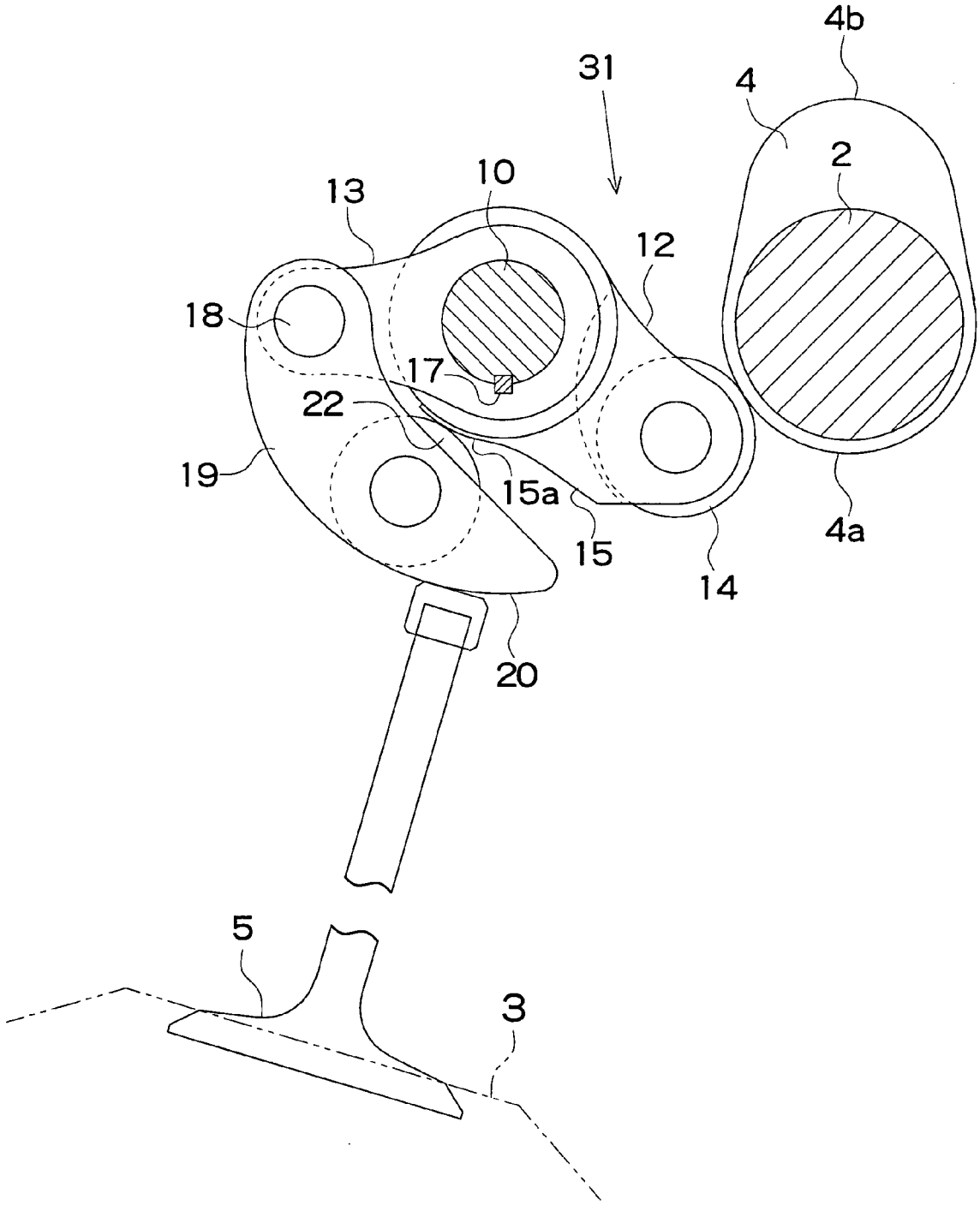
FIG. 7 is a cross-sectional view of the variable valve mechanism according to a second embodiment of the present invention.

A second embodiment of the present invention is shown in FIGS. 7 to 9. This variable valve mechanism 31 is structured such that a drive arm 19 directly drives a valve 5. The proximal end of the drive arm 19 is linked to the rod 18 of a variable arm 13, and the middle portion thereof is provided with a cam follower 22 that contacts with the cam surface 15 of the swing arm 12. At the distal end of the drive arm 19, a valve drive portion 20, which abuts the upper end surface of the valve 5, is formed so as to be included in the cylindrical surface that is concentric with the constant radius portion 15*a* of the cam surface 15.

Figure 8B:
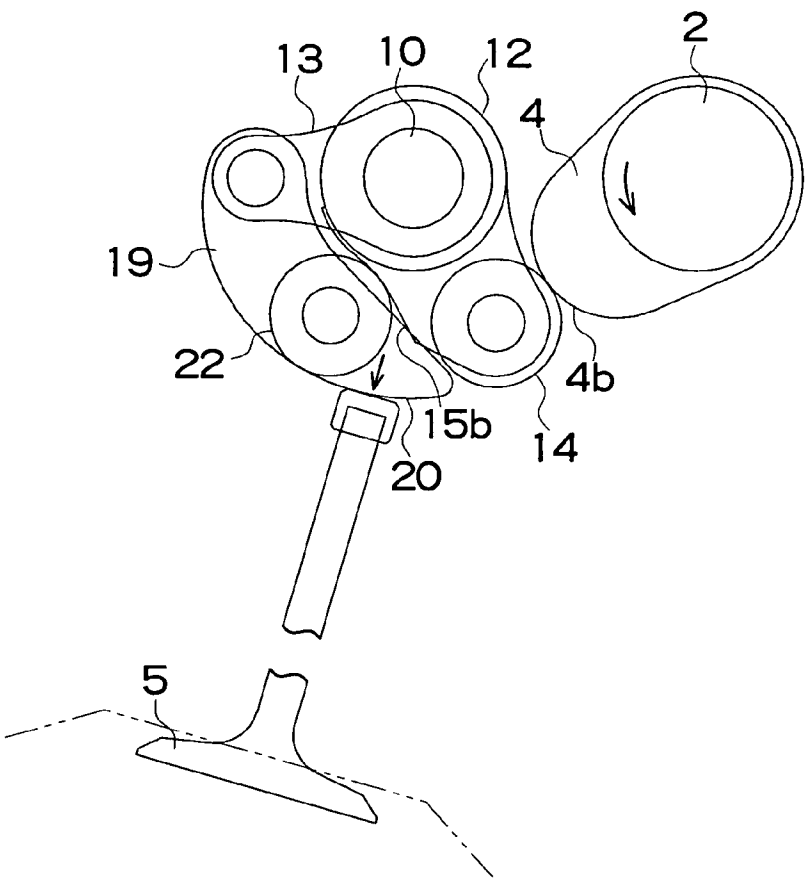
FIGS. 8A and 8B show structural diagrams showing the operation when the valve lift amount is minimized in the variable valve mechanism of the second embodiment.
Figure 8A:
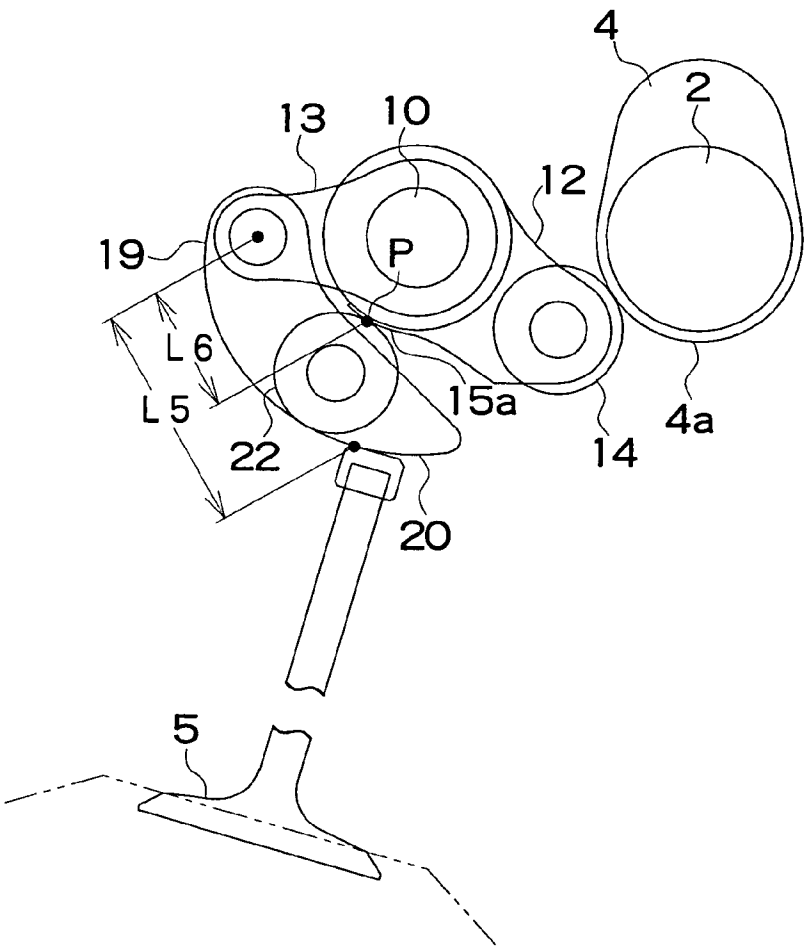

In addition, as shown in FIG. 8A, when the valves 5 are opened and closed by the minimum lift amount, the cam follower 22 contacts with the leading edge side of the constant radius portion 15*a*, and while the base portion 4*a* of the rotating cam 4 is engaged with the input roller 14, the swing arm 12 and the drive arm 19 are both stationary, and the valves 5 are maintained in the closed position. As shown in FIG. 8B, when the apex of the nose portion 4*b* is engaged with the input roller 14, the swing arm 12 swings downward, the lift portion 15*b* rotates the drive arms 19 via the cam follower 22, and the valve drive portions 20 presses the valves 5 downward by the minimum lift amount.

Figure 9B:
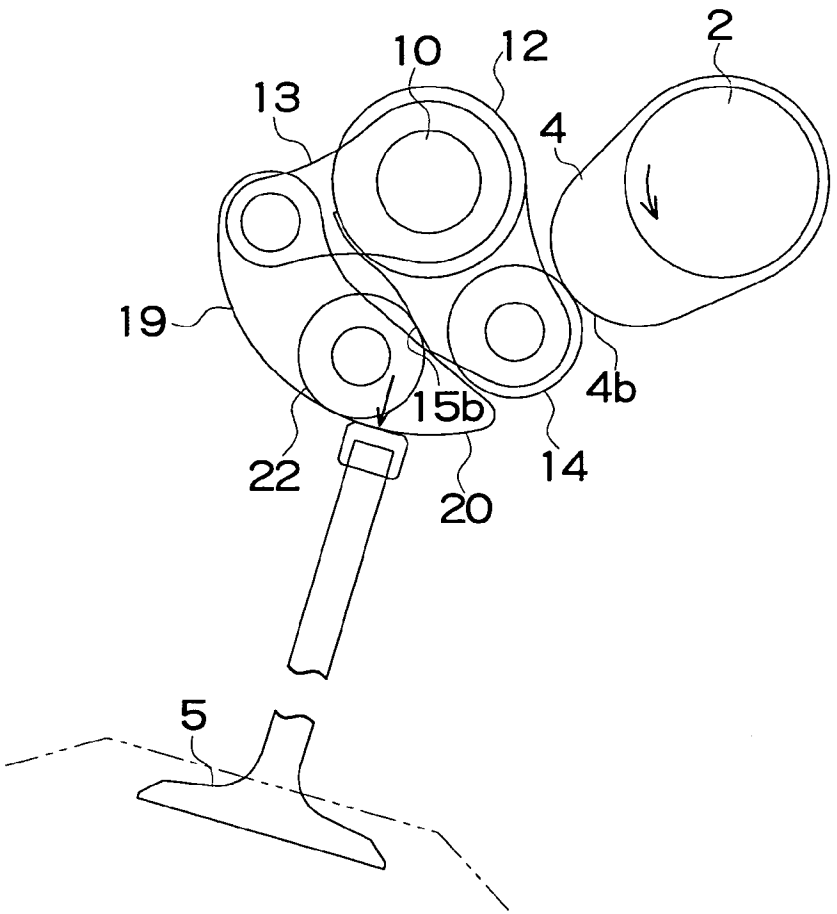
FIGS. 9A and 9B show structural diagrams showing the operation when the valve lift amount is maximized in the variable valve mechanism of the second embodiment.
Figure 9A:
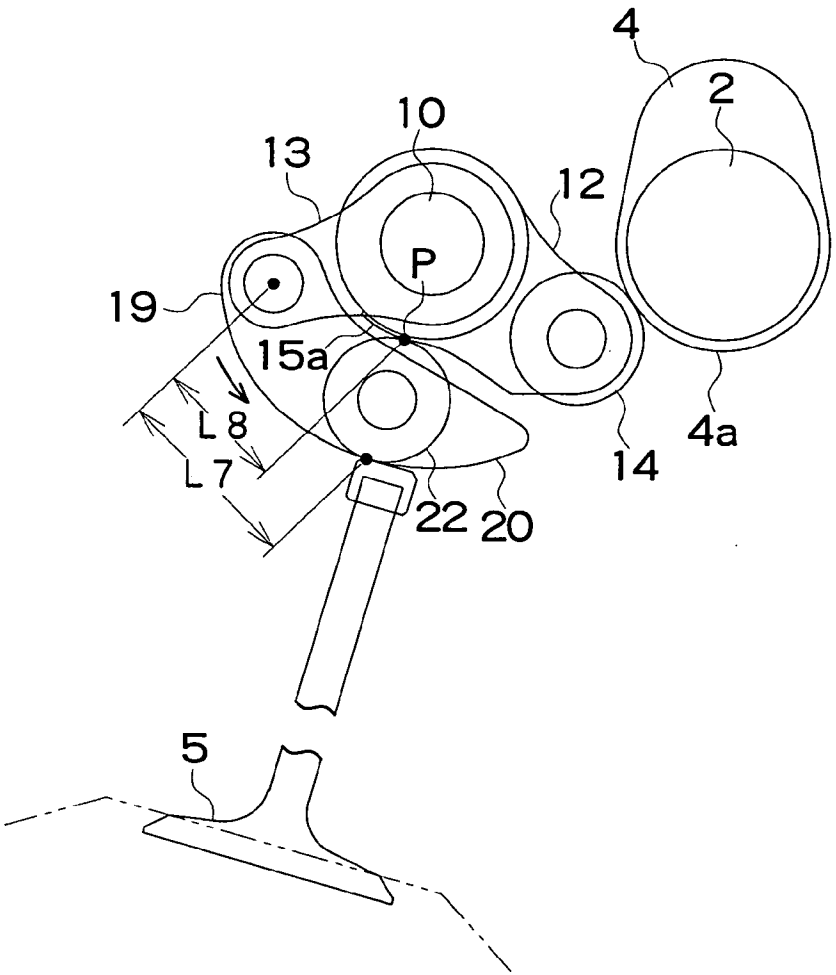
Figure 10:
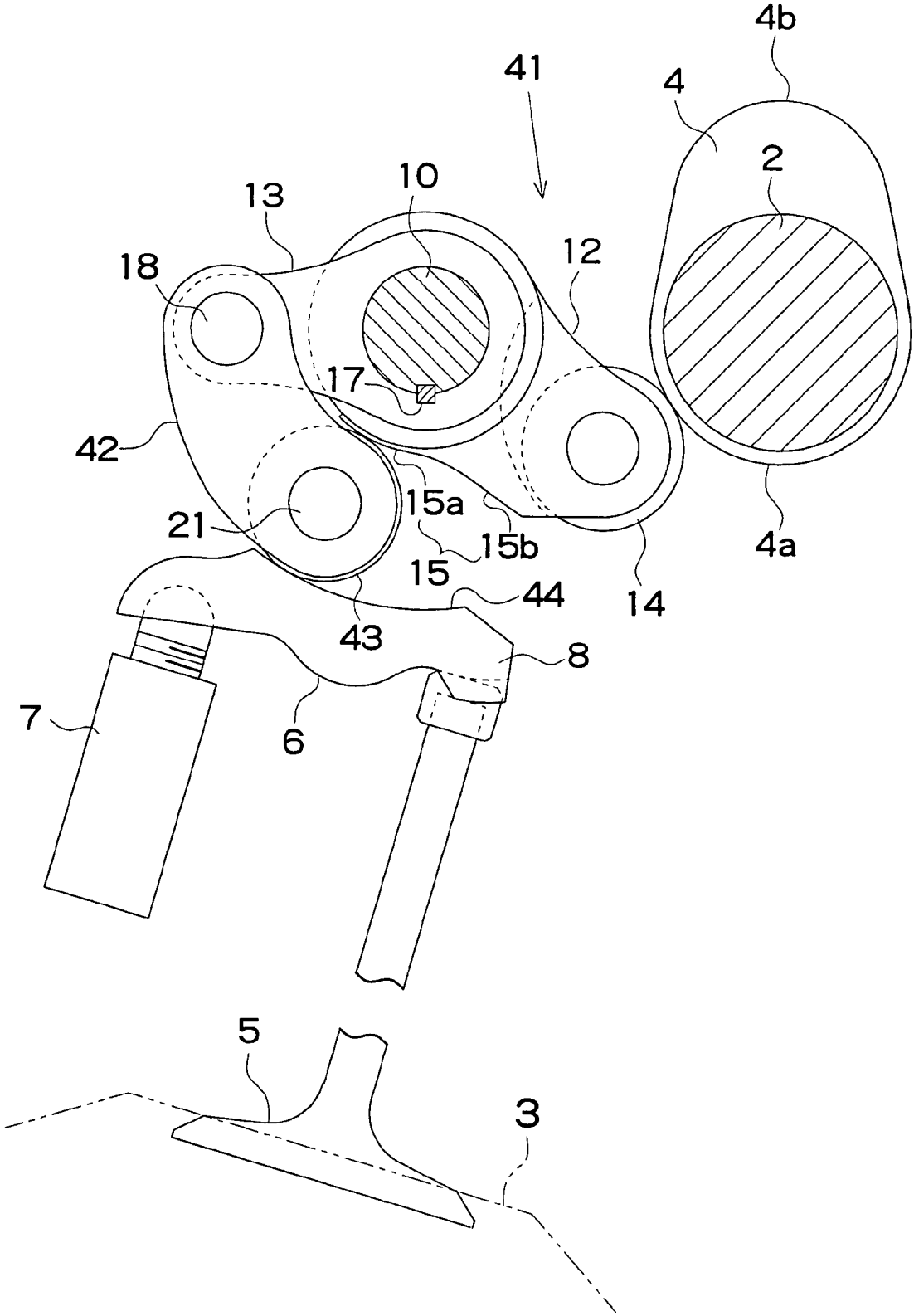
FIG. 10 is a cross-sectional view of the variable valve mechanism according to a third embodiment of the present invention.

In addition, as shown in FIG. 9A, when the valves 5 are opened and closed by the maximum lift amount, the variable arms 13 turn the drive arms 19 around the shaft center of the control shaft 10, and the cam follower 22 is brought into contact with the trailing edge side of the constant radius portion 15*a*. At this time, because the valve drive portions 20 of the drive arms 19 are formed concentrically with the constant radius portion 15*a*, while the base portion 4*a* is engaged with the input roller 14, even if the drive arms 19 turn, the valves 5 are maintained in a closed position. As shown in FIG. 9B, when the apex of the nose portion 4*b* engages the input roller 14, the lift portion 15*b* rotates the drive arms 19 downward by a large angle, and the valve drive portions 20 press the valves 5 downward by the maximum lift amount.

Therefore, similar to the first embodiment, in the variable valve mechanism 31 of the second embodiment as well, while the swing arm 12 is held stationary, it is possible to change the initial positions of the drive arms 19 accurately. In addition, because the arm ratio of the drive arms 19 increases as the initial contact point position P is adjusted toward the leading edge side of the constant radius portion 15*a* (L5/L6 in FIG. 8A>L7/L8 in FIG. 9A), valve characteristics that are advantageous in terms of stable combustion during low speed operation can be obtained. In addition, because the drive arm 19 directly drives the valve 5, in comparison to the first embodiment, there is the unique effect that the number of parts in the valve train becomes smaller.

THIRD EMBODIMENT

A third embodiment of the present invention is shown in FIGS. 10 to 12B. In this variable valve mechanism 41, similar to the first embodiment, a drive arm 42 indirectly drives a valve 5 via a rocker arm 6. However, unlike the first embodiment, a cam follower 43 is provided on the distal end of a drive arm 42. That is, the cam follower 43 forms a cam device that contacts with the cam surface 15 of the swing arm 12, and at the same time, functions as a valve drive portion that contacts with the curved surface 44 of a rocker arm 6. The upper surface 44 of the rocker arm 6 is formed into a concave shape so as to be included in the cylindrical surface that is concentric with the constant radius portion 15*a* of the cam surface 15 in the initial position.

Figure 11B:
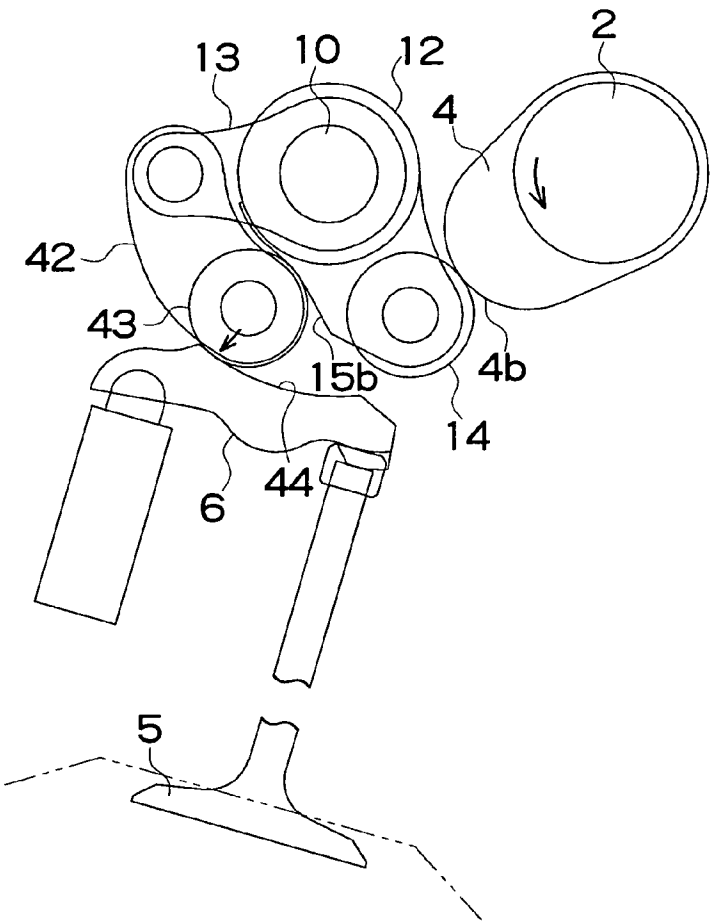
FIGS. 11A and 11B show structural diagrams showing the operation when the valve lift amount is minimized in the variable valve mechanism of the third embodiment.
Figure 11A:
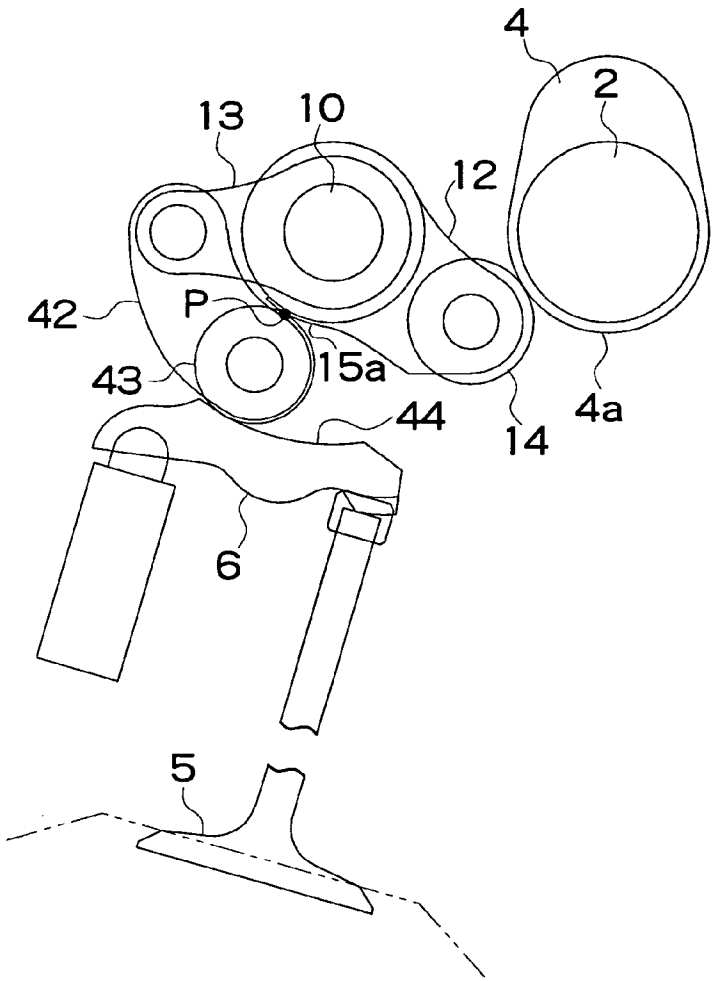

In addition, as shown in FIG. 11A, when the valves 5 are opened and closed by the minimum lift amount, while the cam follower 43 is in contact with the leading edge side of the constant radius portion 15*a* and the base portion 4*a* of the rotating cam 4 is engaged with the input roller 14, the swing arm 12, the drive arms 42, and the rocker arms 6 are all stationary, and the valves 5 are maintained in the closed position. As shown in FIG. 11B, when the apex of the nose portion 14*b* engages with the input roller 14, the swing arm 12 swings downward, the leading edge side of the lift portion 15*b* is brought into contact with the cam follower 43 to rotate the drive arms 42, the drive arms 42 rotate the cam follower 43 on the curved surface 44 to press the rocker arms 6 slightly downward, and the valves 5 are driven by the minimum lift amount.

Figure 12B:
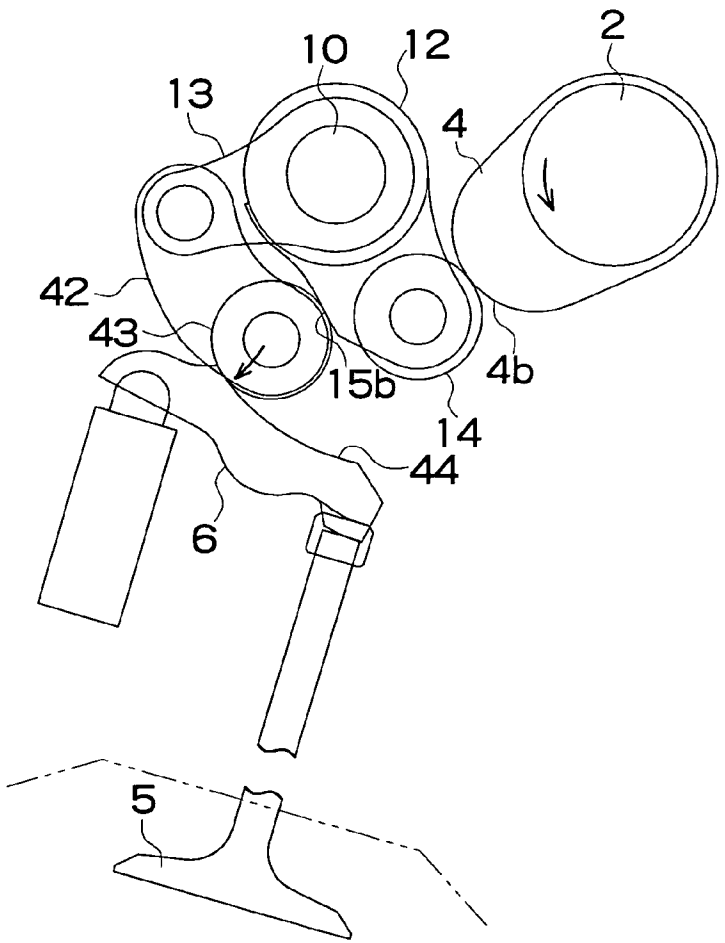
FIGS. 12A and 12B show structural diagrams showing the operation when the valve lift amount is maximized in the variable valve mechanism of the third embodiment.
Figure 12A:
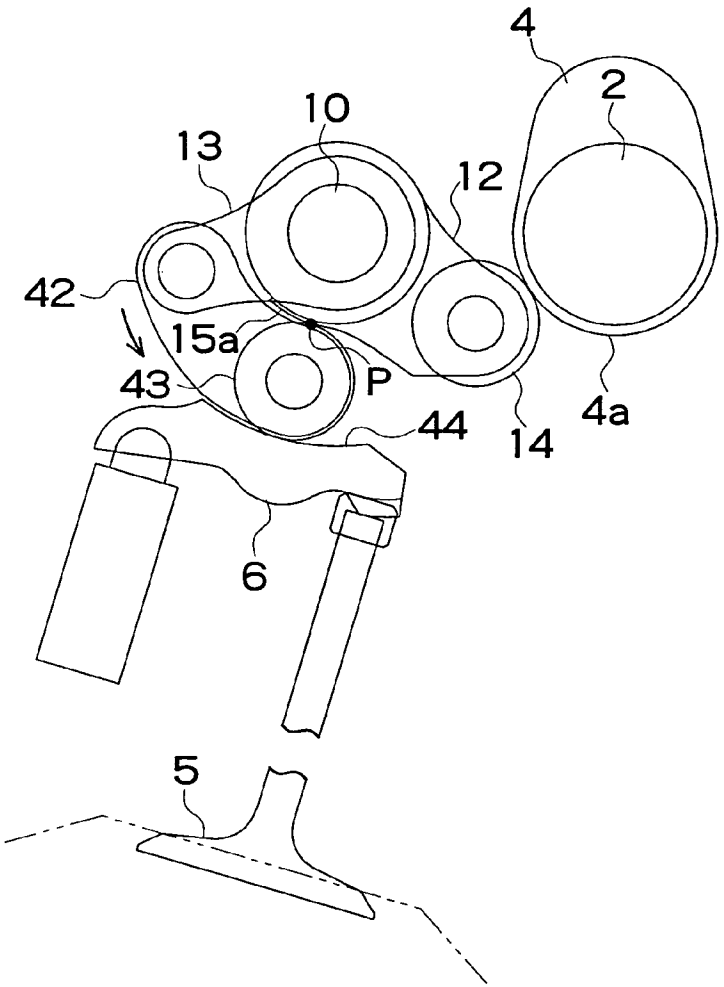
Figure 13:
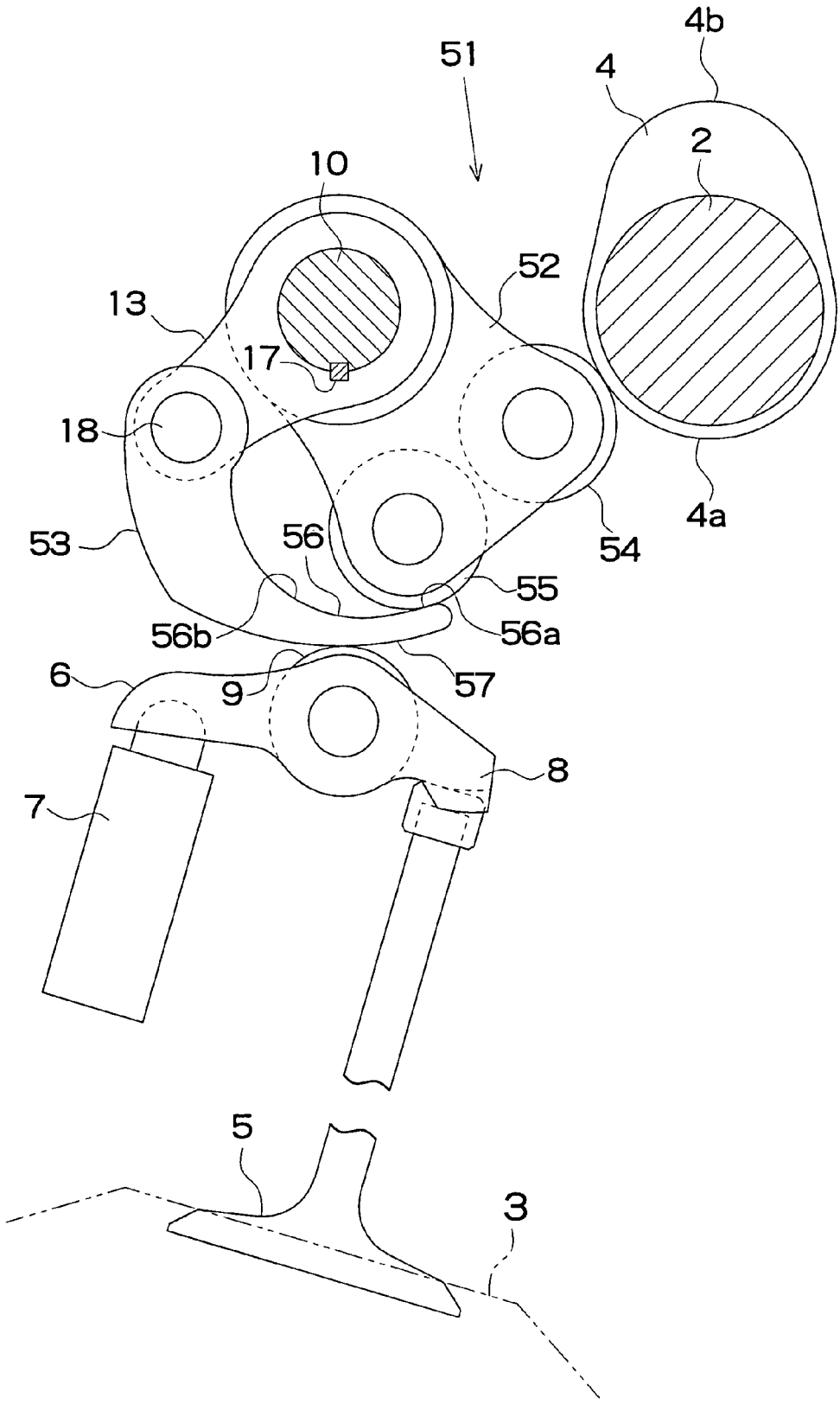
FIG. 13 is a cross-sectional view of the variable valve mechanism according to a fourth embodiment of the present invention.

In addition, as shown in FIG. 12A, when the valves 5 are opened and closed by the maximum lift amount, the variable arms 13 turn the drive arms 42 around the swing axis of the swing arm 12, and the cam follower 43 is thereby brought into contact with the trailing edge side of the constant radius portion 15*a*. At this time, because the curved surface 44 of the rocker arm 6 is formed into a concave shape that is concentric with the constant radius portion 15*a*, while the base portion 4*a* is engaged with the input roller 14, even if the drive arms 42 turn, the rocker arms 6 are stationary, and the valves 5 are maintained in the closed position. As shown in FIG. 12B, when the apex of the nose portion 4*b* is engaged with the input roller 14, the swing arm 12 brings the trailing edge side of the lift portion 15*b* into contact with the cam follower 43 to rotate the drive arms 42, the drive arms 42 press the rocker arms 6 down by a large angle by the cam follower 43, and the valves 5 are driven by the maximum lift amount.

Therefore, similar to the first embodiment, in the variable valve mechanism 41 of the third embodiment, while the swing arm 12 is held stationary, it is possible to change the initial position of the drive arms 42 accurately. In addition, because the cam follower 43, which is a rotating body, is made to function as a valve drive portion, the roller can be eliminated from the rocker arms 6, and it is possible to increase the responsiveness of the rocker arms 6 during high speed.

FOURTH EMBODIMENT

A fourth embodiment of the present invention is shown in FIGS. 13 to 15B. This variable valve mechanism 51 differs from each of the embodiments described above in relation to the structures of the swing arm 52 and the drive arms 53. A swing arm 52 is formed in a substantially triangular shape, the top portion is supported by the control shaft 10, and an input roller 54 and a cam follower 55 are provided on the base portion. A drive arm 53 is formed in a beak shape, the proximal end thereof is linked to the rod 18 of a variable arm 13, an upward-facing cam surface 56 that contacts with the cam follower 55 is provided at the distal end side thereof, and a downward facing valve drive portion 57 that engages with the roller 9 of a rocker arm 6 is formed at the middle portion thereof. A constant radius portion 56*a* that is centered on the shaft center of the control shaft 10 and a lift portion 56*b* that projects toward the control shaft 10 side from the constant radius portion 56*a* are provided on the cam surface 56.

Figure 14B:
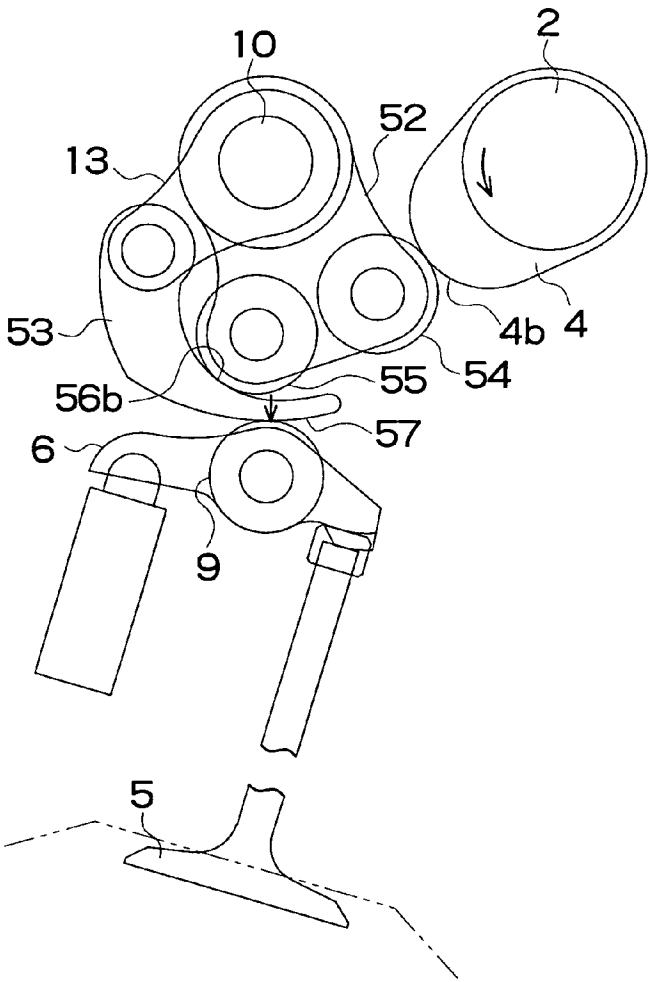
FIGS. 14A and 14B show structural diagrams showing the operation when the valve lift amount is minimized in the variable valve mechanism of the fourth embodiment.
Figure 14A:
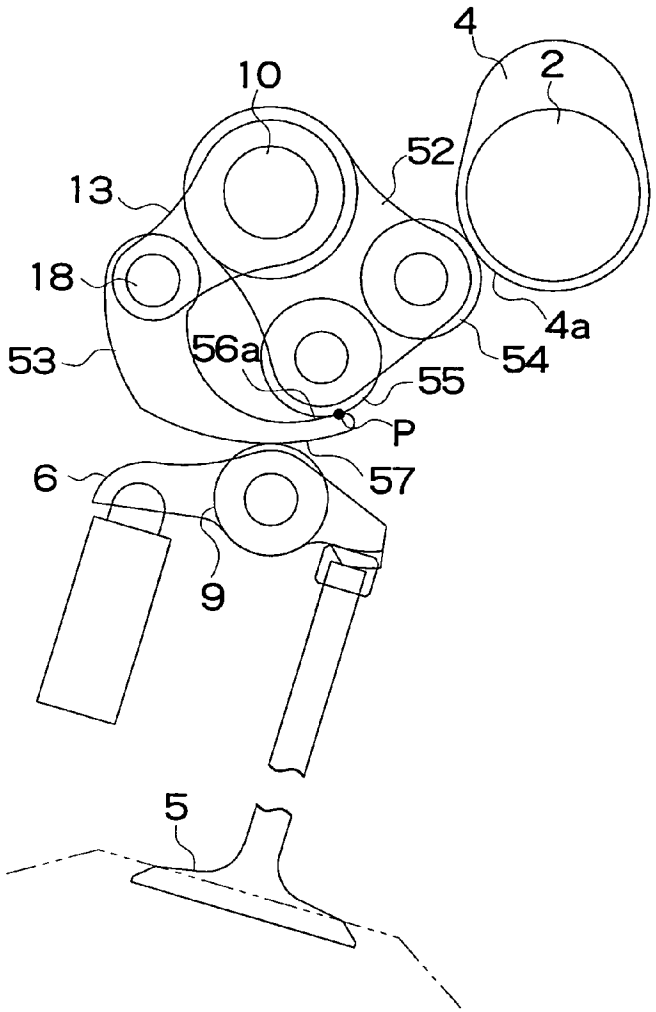

As shown in FIG. 14A, when the valves 5 are opened and closed by the minimum lift amount, while the cam follower 55 is in contact with the leading edge side of the constant radius portion 56*a* and the base portion 4*a* of the rotating cam 4 is engaged with the input roller 54, the swing arm 52, the drive arms 53, and the rocker arms 6 are all stationary, and the valves 5 are maintained in the closed position. As shown in FIG. 14B, when the apex of the nose portion 4*b* is engaged with the input roller 54, the swing arm 52 swings in a clockwise direction, the cam follower 55 contacts with the lift portion 56*b* to rotate the drive arms 53, the valve drive portions 57 press the rocker arms 6 down via the rollers 9 by a small angle, and the valves 5 are driven by the minimum lift amount.

Figure 15B:
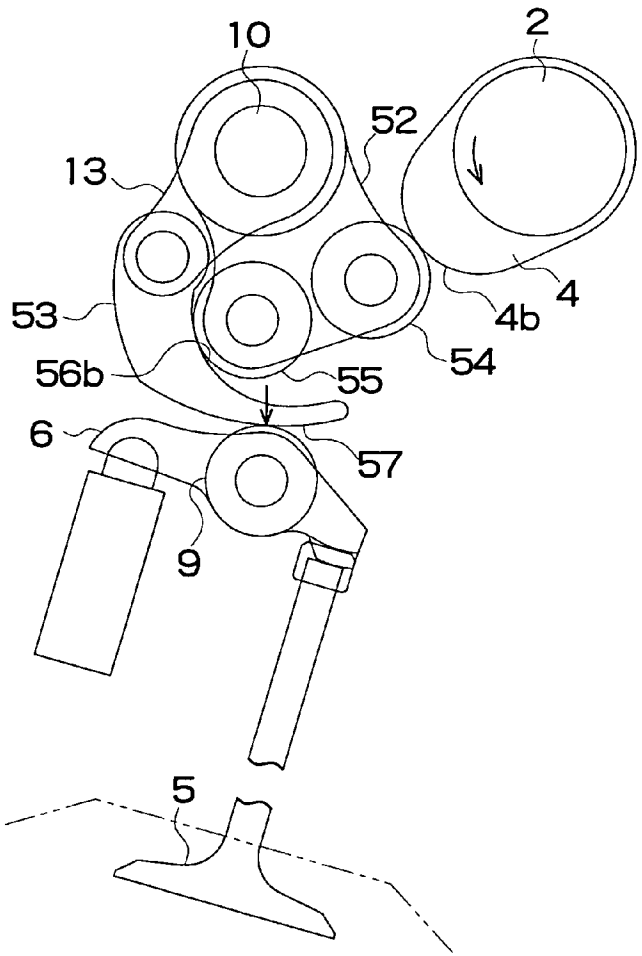
FIGS. 15A and 15B show structural diagrams showing the operation when the valve lift amount is maximized in the variable valve mechanism of the fourth embodiment.
Figure 15A:
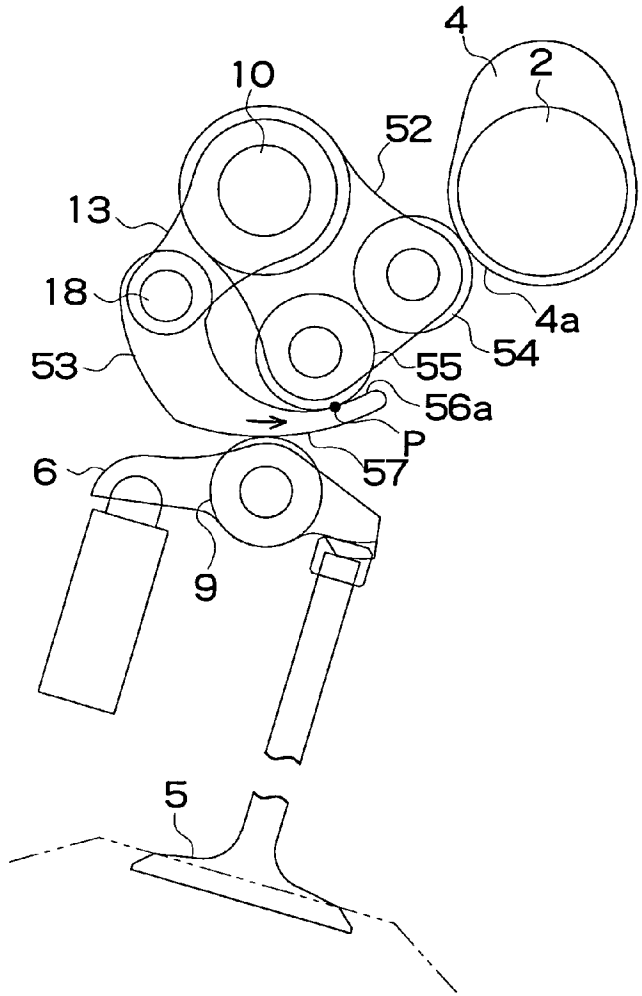

As shown in FIG. 15A, when the valves 5 are opened and closed by the maximum lift amount, the variable arms 13 turn the drive arms 53 around the shaft center of the control shaft 10, and the trailing end side of the constant radius portion 56*a* is brought into contact with the cam follower 55. The valve drive portions 57 are formed concentric with the constant radius portion 56*a*, and while the base portion 4*a* is engaged with the input roller 54, the valves 5 are maintained in the closed position. As shown in FIG. 15B, when the apex of the nose portion 4*b* is engaged with the input roller 54, the cam follower 55 contacts with the lift portion 56*b*, and the valve drive portion 57 drives the valve 5 via the rocker arms 6 by the maximum lift amount.

Therefore, in this variable valve mechanism 51 as well, while the swing arm 52 is held stationary, it is possible to change the initial position of the drive arms 53 accurately. In addition, because the cam follower 55 shifts significantly from the distal end side of the drive arms 53 toward the proximal end side thereof accompanying the swinging of the swing arm 52, in particular, there are the effects that the arm ratio of the drive arms 53 becomes large during high speed rotation (refer to FIG. 15B), the valve lift amount is increased, and a high output can be obtained.

FIFTH EMBODIMENT

A fifth embodiment of the present invention is shown in FIGS. 16 to 19B. In a gasoline engine for a vehicle that has a plurality of cylinders, this variable valve mechanism 61 is provided with a housing 62 above the cylinder head 3. In the housing 62, the camshaft 2, the support shaft 63, and the control shaft 64 are supported in parallel. On the support shaft 63, for each cylinder, one swing arm 65 and two variable arms 66, one on the left and one on the right, are supported so as to be able to rotate relatively to each other around a common axis. On the distal end of the swing arm 65, an input roller 67, which engages with the rotating cam 4, and the pair of left and right cam followers 68 are supported so as to be able to rotate by a common shaft 69.

The proximal end of a beak-shaped drive arm 70 is linked to the distal end of the variable arm 66 so as to be able to swing vertically by a linking shaft 71. An upward-facing cam surface 72 that contacts with the cam follower 68 is provided on the distal end side of the drive arm 70, and a downward-facing valve drive portion 73 that engages with the roller 9 of the rocker arm 6 is formed at the middle portion of the drive arm 70. A constant radius portion 72*a* that is centered on the axis of the support shaft 63 and a lift portion 72*b* that projects from the constant radius portion 72*a* toward the support shaft 63 side are provided on the cam surface 72. In addition, the valve drive portion 73 is formed so as to be included on the cylindrical surface that is concentric with the constant radius portion 72*a*.

Figure 17A:
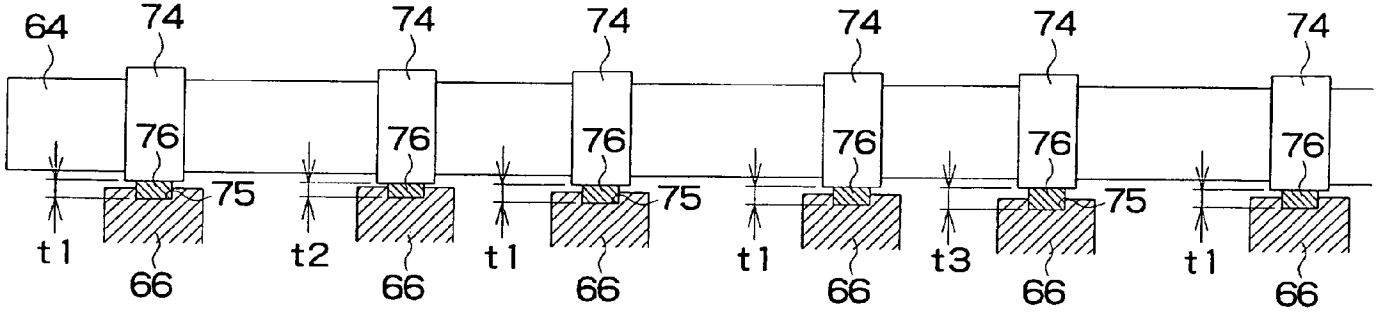
FIG. 17 is a block plan of the variable valve mechanism of a gasoline engine having a plurality of cylinders according to the fifth embodiment.
Figure 17B:
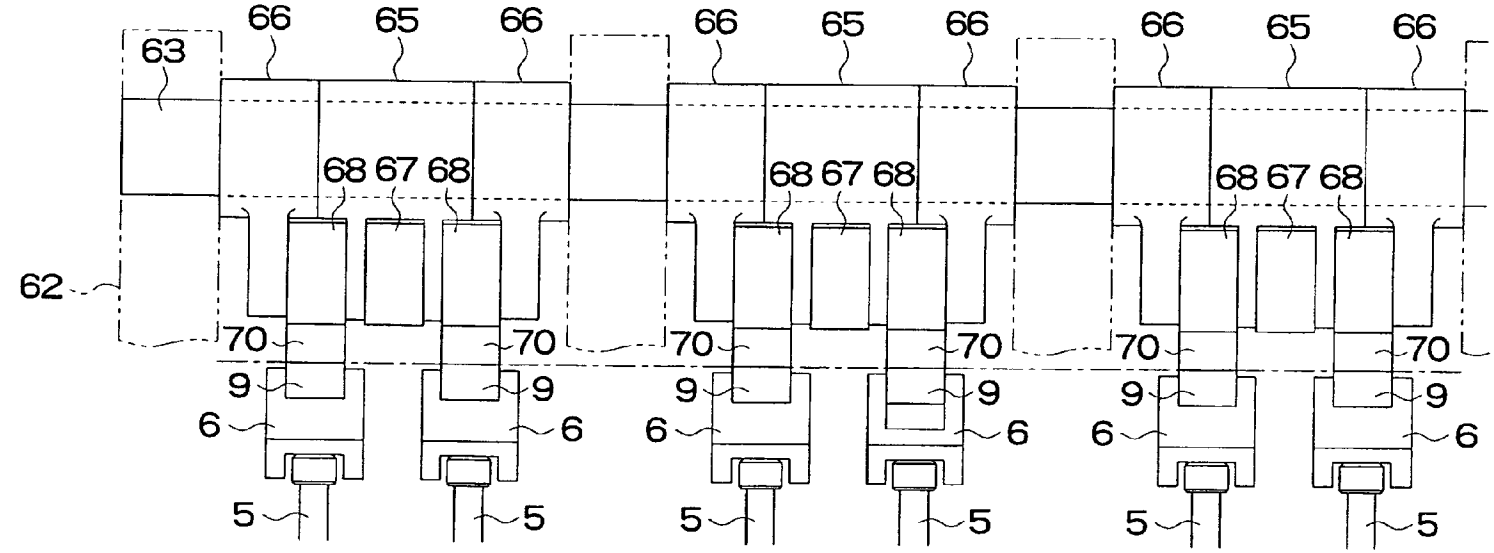

On the control shaft 64, two control cams 74 that drive the variable arms 66 are provided for each cylinder. The control cam 74 is provided with a cam surface 74*a* that is deflected from the shaft center of the control shaft 64 and is rotated integrally with the control shaft 64 by the actuator 11 (refer to FIG. 1). On the variable arm 66, a concave groove 75 is formed on the surface opposite to the cam surface 74*a*, and a shim 76 is placed in the concave groove 75 so as to be interposed between the variable arm 66 and the control cam 74. Note that in addition to the prismatic shaped shim that is shown in FIG. 17A, a split-columnar shim can also be used for the shim 76.

Figure 18B:
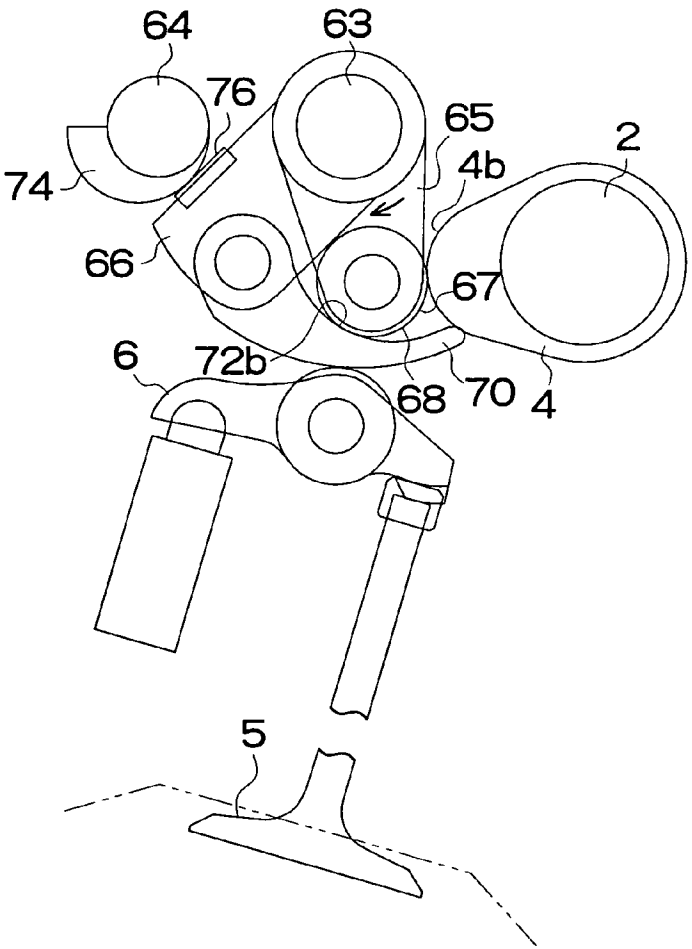
FIGS. 18A and 18B show structural diagrams showing the operation when the valve lift amount is minimized in the variable valve mechanism of the fifth embodiment.
Figure 18A:
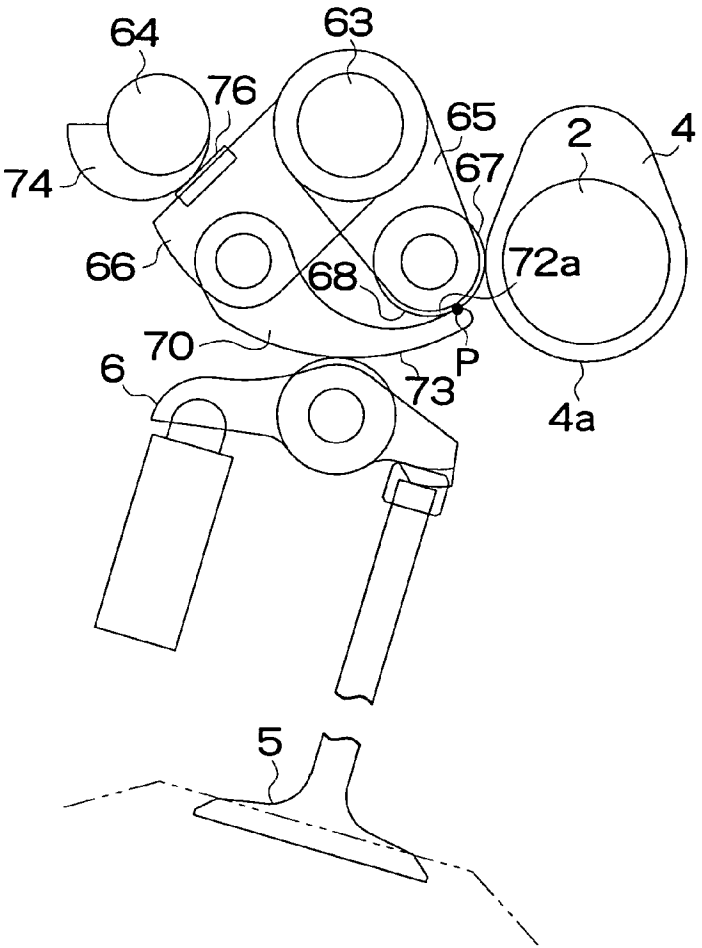

In the variable valve mechanism 61 having the structure described above, as shown in FIG. 18A, when the valves 5 are opened and closed by the minimum lift amount, the initial contact point position P of the swing arm 65 and the drive arm 70 is adjusted by the control cam 74 toward the leading edge side of the constant radius portion 72*a*. While the base portion 4*a* of the rotating cam 4 is engaged with the input roller 67, the swing arm 65, the drive arms 70, and the rocker arms 6 are all stationary, and the valves 5 are maintained in the closed position. As shown in FIG. 18B, when the apex of the nose portion 4*b* is engaged with the input roller 67, the swing arm 65 swings in the direction of the arrow, the cam follower 68 shallowly contacts with the lift portion 72*b*, the drive arms 70 swing slightly downward to press the rocker arms 6 downward by a small angel, and the valves 5 are opened and closed by the minimum lift amount.

Figure 19B:
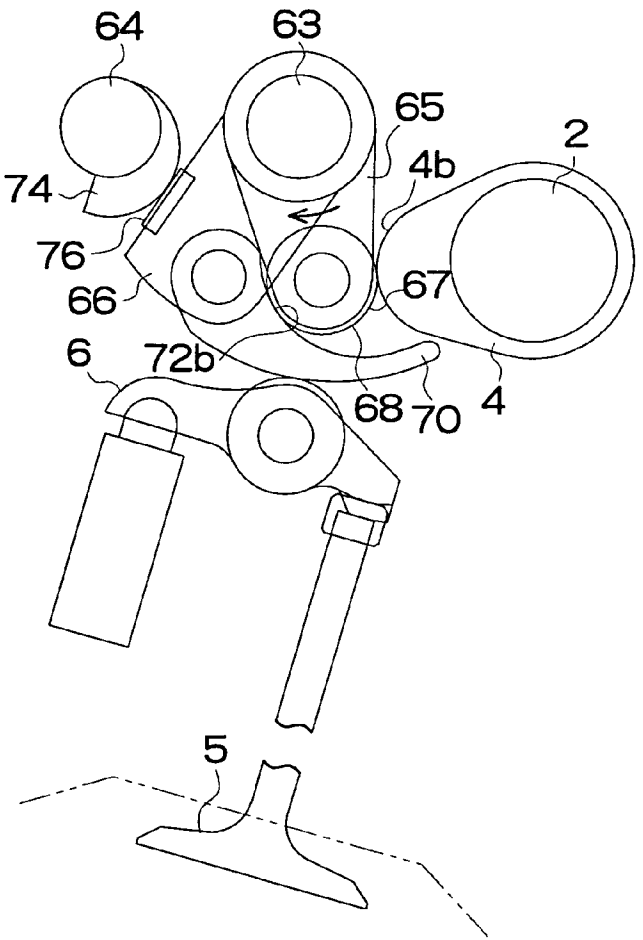
FIGS. 19A and 19B show structural diagrams showing the operation when the valve lift amount is maximized in the variable valve mechanism of the fifth embodiment.
Figure 19A:
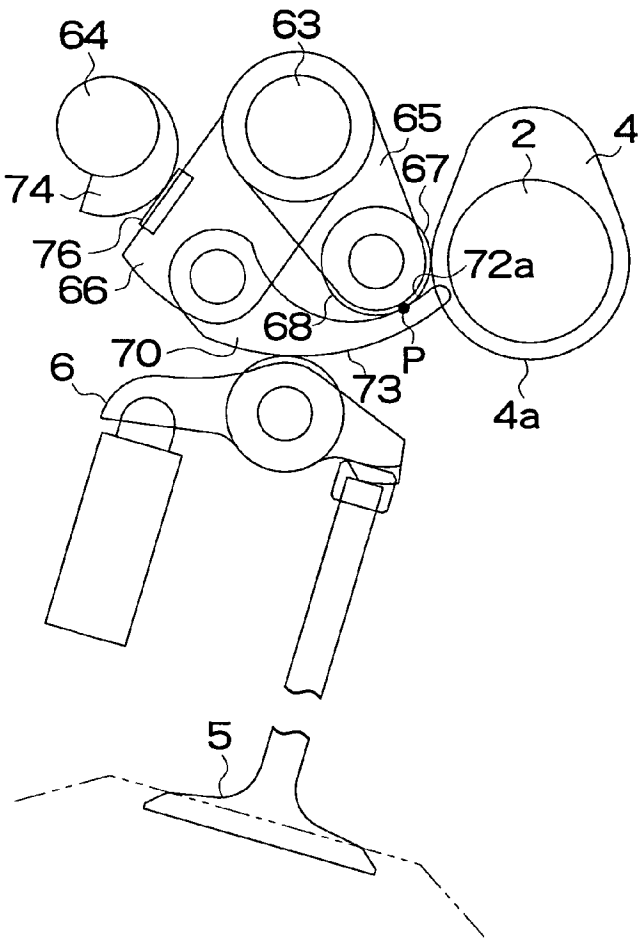

As shown in FIG. 19A, when the valves 5 are opened and closed by the maximum lift amount, the initial contact point position P of the swing arm 65 and the drive arm 70 is adjusted toward the trailing edge side of the constant radius portion 72*a* by the control cam 74. At this time, because the valve drive portion 73 is formed concentrically with the constant radius portion 72*a*, while the base portion 4*a* is engaged with the input roller 67, irrespective of changes in the initial contact point position P, the valves 5 are maintained in the closed position. In contrast, as shown in FIG. 19B, when the apex of the nose portion 4*b* is engaged with the input roller 67, the cam follower 68 deeply contacts with the lift portion 72*b*, the drive arms 70 swing significantly downward to press the rocker arms 6 downward by a large angle, and the valves 5 are opened and closed by the maximum lift amount.

Therefore, according to this variable valve mechanism 61, because the swing arm 65 and the variable arms 66 are supported so as to be able to rotate relatively to each other on the common support shaft 63, similar to the embodiments described above, while the swing arm 65 is held stationary, the initial contact point position P of the swing arm 65 and the drive arm 70 can be changed accurately. In addition, as shown in FIG. 17A, because the shim 76 is interposed between the variable arm 66 and the control arm 74, by changing the thickness (t2<t1<t3) of the shim 76, it is possible to finely adjust the positions of the variable arms 66 and the drive arms 70 with respect to the swing arm 65. Thus, in a gasoline engine having a plurality of cylinders, even if the precision of the dimensions and the precision of the assembly of the valve train components are not strictly managed, it is possible to control variation in the valve characteristics between cylinders simply, and it is thereby possible to anticipate advantageous effects with respect to fuel consumption, emissions, engine vibration, and the like.

Figure 16:
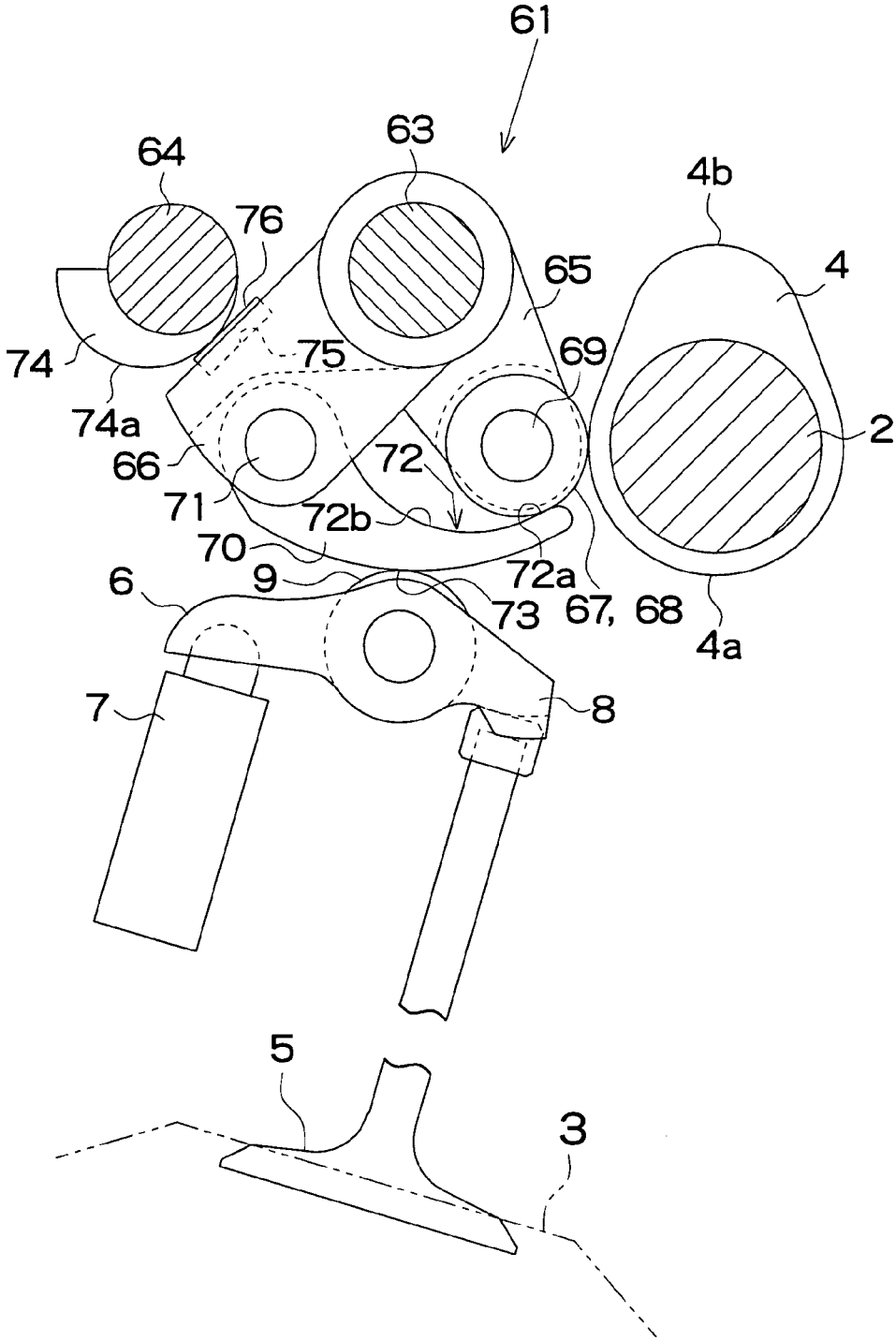
FIG. 16 is a cross-sectional view of the variable valve mechanism according to a fifth embodiment of the present invention.

Furthermore, as shown in FIG. 16, in the variable valve mechanism 61 of the present embodiment, the distal ends of the variable arms 66 are below the support shaft 63 when the valves 5 are opened and closed by the minimum lift amount, a variable arm 66 is slanted as a whole toward the distal end, and there is a slanted surface that slants downward toward the distal end that is opposite to the cam surface 74*a*. Thereby the control shaft 64 can be provided on the side of the variable arms 66, and thus, the overall height of the internal combustion engine can be reduced, and the internal combustion engine can be made more compact overall.

SIXTH EMBODIMENT

Figure 20:
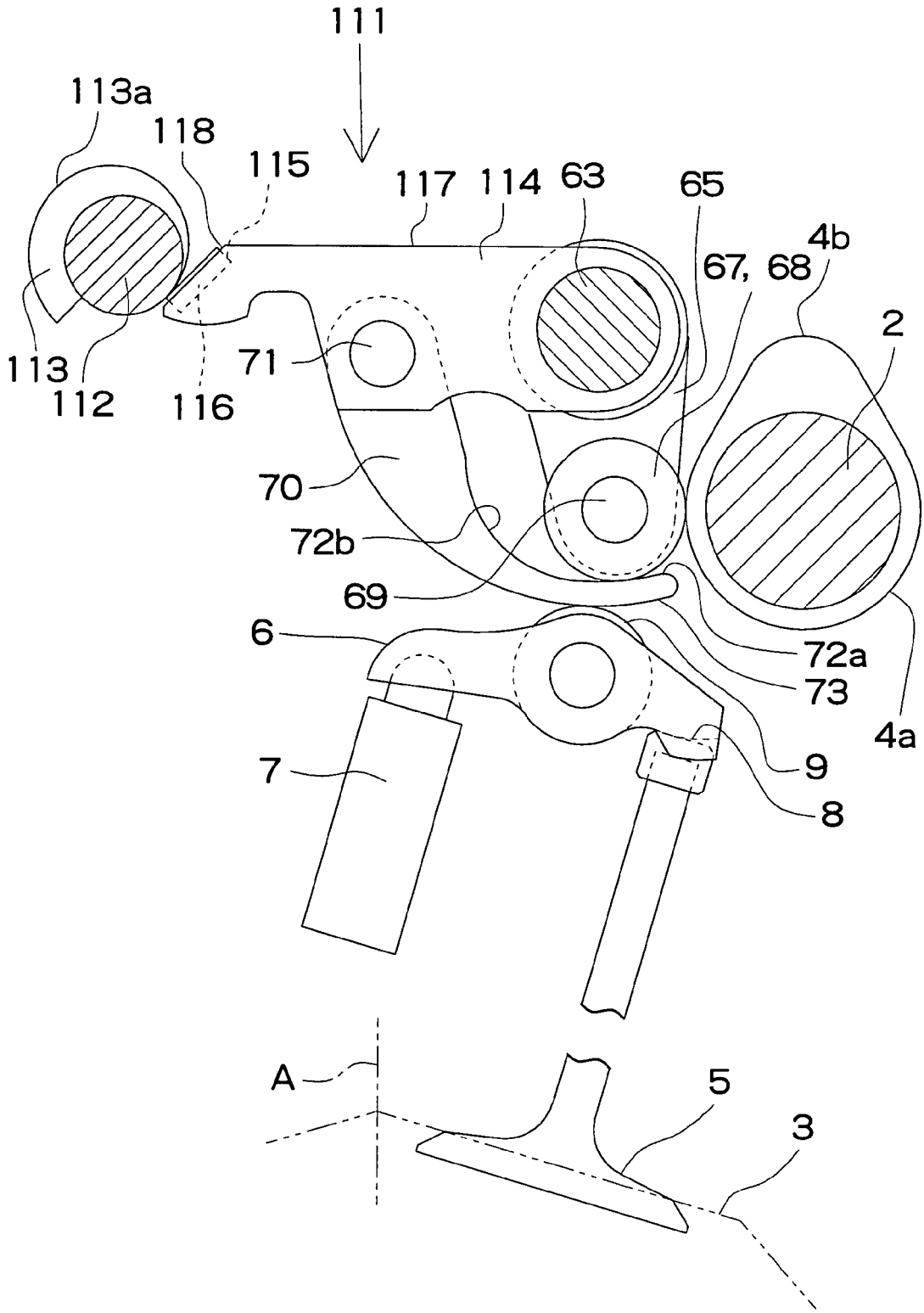
FIG. 20 is a cross-sectional view of the variable valve mechanism according to a sixth embodiment of the present invention.

A sixth embodiment of the present invention is shown in FIG. 20 to FIG. 22. This variable valve mechanism 111 differs from the fifth embodiment with respect to the linking position of a drive arm 70 to a variable arm 114 and the support state of the variable arm 114 when the valve 5 is opened and closed by the minimum lift amount. At the center portion of a variable arm 114 in the longitudinal direction, the proximal end of a beak-shaped drive arm 70 is linked so as to be able to swing vertically by a linking shaft 71. When the valve 5 is opened and closed by the minimum lift amount, the variable arm 114 is supported such that an upper surface 117 becomes substantially horizontal. In proximity to the distal end of the variable arm 114, there is a slanted surface 118 that slants downward toward the distal end that is opposite to a cam surface 113*a*, which will be described below, a concave groove 115 is formed in the slanted surface 118, and a shim 116 is placed in the concave grove 115 so as to be interposed between the variable arm 114 and the control cam 113. A control shaft 112, which is parallel to the camshaft 2, is provided on the side of the variable arm 114. Two control cams 113 that drive the variable arms 114 are provided for each cylinder on the control shaft 112. The control cam 113 is provided with the cam surface 113*a* that is deflected from the shaft center of the control shift 112 and is rotated integrally with the control shaft 112 by the actuator 11 (refer to FIG. 1). Note that in addition to a prismatic-shaped shim such as that shown in FIG. 20, a split-columnar shim can also be used for the shim 116.

Figure 21B:
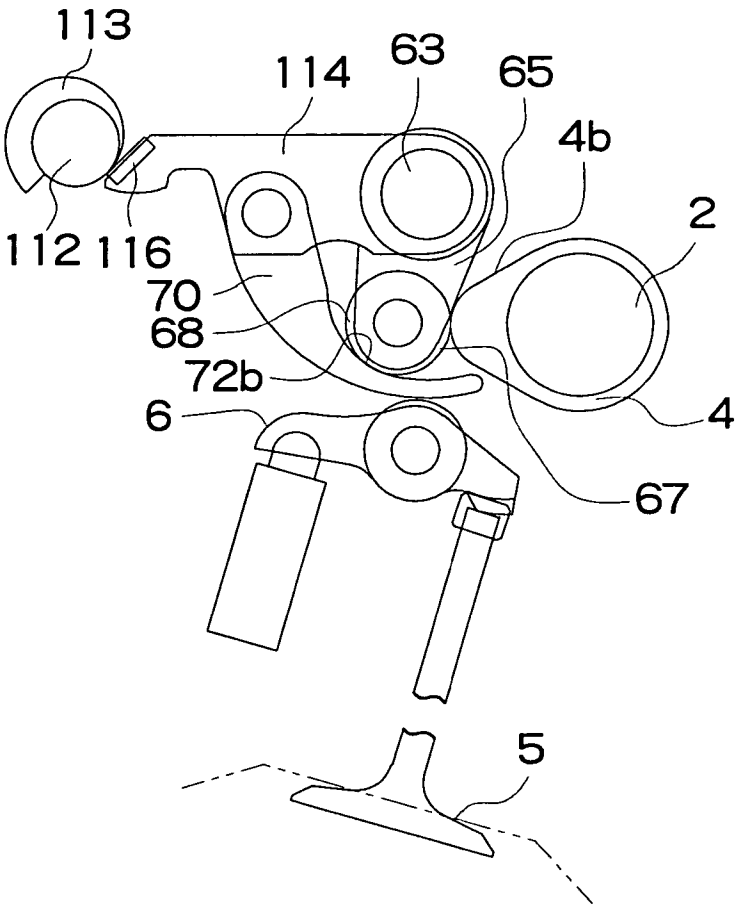
FIGS. 21A and 21B show structural diagrams showing the operation when the valve lift amount is minimized in the variable valve mechanism of the sixth embodiment.
Figure 21A:
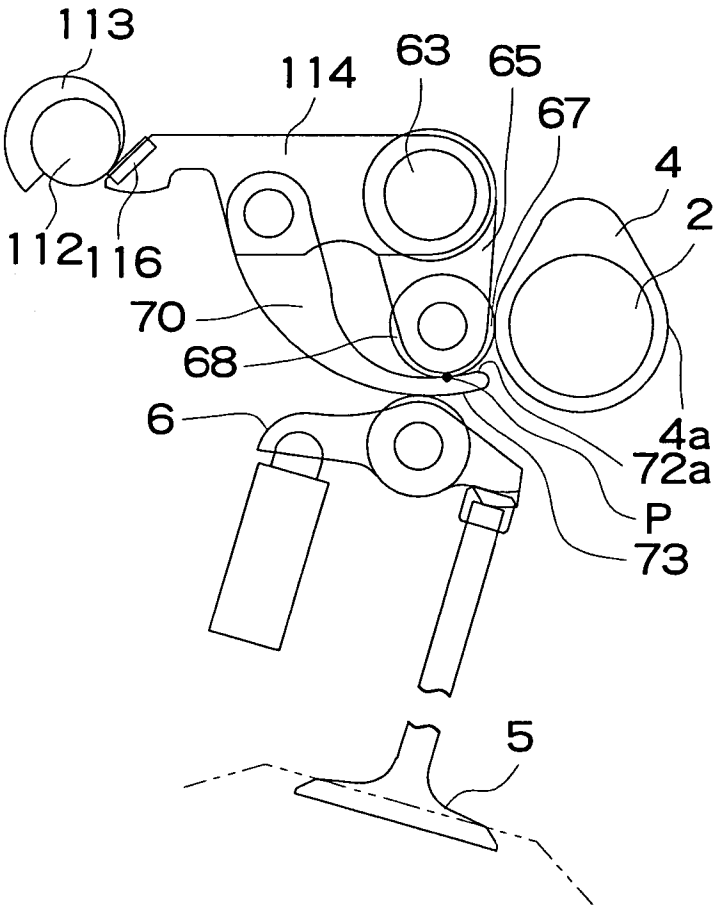

In the variable valve mechanism 111 having the structure described above, as shown in FIG. 21A, when the valves 5 are opened and closed by the minimum lift amount, the initial contact point position P of the swing arm 65 and the drive arm 70 is adjusted toward the leading edge side of the constant radius portion 72*a* by the control cam 113. While the base portion 4*a* of the rotating cam 4 is engaged with the input roller 67, the swing arm 65, the drive arms 70, and the rocker arms 6 are all stationary, and the valves 5 are maintained in the closed position. As shown in FIG. 21B, when the apex of the nose portion 4*b* of the rotating cam 4 is engaged with the input roller 67, the swing arm 65 swings, the cam follower 68 shallowly contacts with the lift portion 72*b*, the drive arms 70 swing slightly downward to press the rocker arms 6 down by a small angle, and the valves 5 are opened and closed by the minimum lift amount.

Figure 22B:
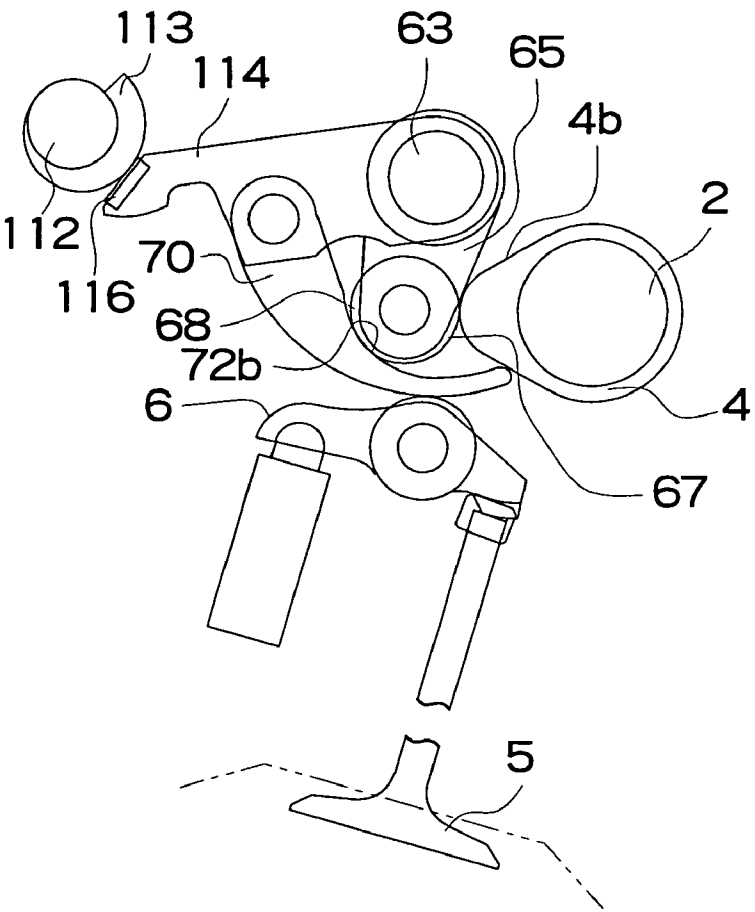
FIGS. 22A and 22B show structural diagrams showing the operation when the valve lift amount is maximized in the variable valve mechanism of the sixth embodiment.
Figure 22A:
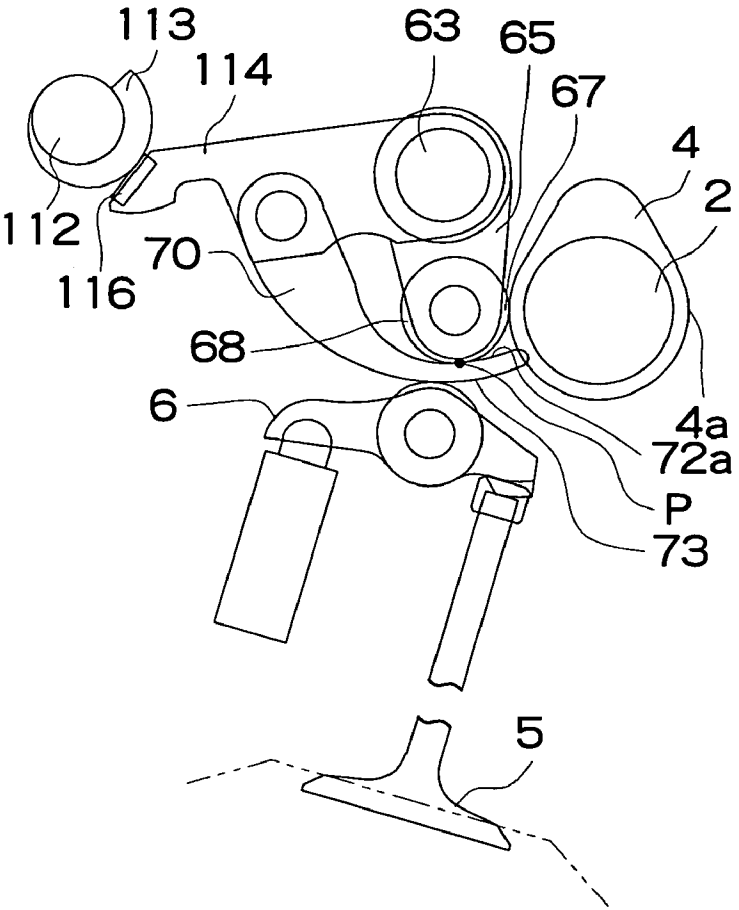

As shown in FIG. 22A, when the valves 5 are opened and closed by the maximum lift amount, the initial contact point position P of the swing arm 65 and the drive arm 70 is adjusted toward the trailing edge side of the constant radius portion 72*a* by the control cam 113. At this time, because the valve drive portion 73 is formed concentrically with the constant radius portion 72*a*, while the base portion 4*a* of the rotating cam 4 is engaged with the input roller 67, irrespective of changes in the initial contact point position P, the valves 5 are maintained in the closed position. In contrast, as shown in FIG. 22B, when the apex of the nose portion 4*b* is engaged with the input roller 67, the cam follower 68 deeply contacts with the lift portion 72*b*, the drive arms 70 swing significantly downward to press the rocker arms 6 down by a large angle, and the valves 5 are opened and closed by the maximum lift amount.

Because the control shaft 112 is provided on the sides of the variable arms 114, the overall height of the internal combustion engine can be reduced, and the internal combustion engine can be made more compact overall.

Because the position at which the control cam 113 and the variable arms 114 are in contact via the shim 116 is separated from the rocking center of the variable arms 114, it is possible to reduce the pressure of the contact portion.

SEVENTH EMBODIMENT

A seventh embodiment of the present invention is shown in FIG. 23. This variable valve mechanism 121 differs from the sixth embodiment on the point of the installation position of the control shaft 122 and the point that the control cam 123 and the variable arms 124 are engaged by a linking pin 128. The control shaft 122, which is parallel to the camshaft 2, is provided below the variable arms 124. On the control shaft 122, two control cams 123, which drive the variable arms 124, are provided for one variable arm 124, and thus, four are provided for each cylinder. The control cam 123 is provided with a cam groove 123*a* that is deflected from the shaft center of the control shaft 122, and is rotated integrally with the control shaft 122 by the actuator 11 (refer to FIG. 1). At the bottom portion of the variable arm 124, a linking pin 128 engages the variable arm 124 and the control cam 123.

In the variable valve mechanism 121 having the structure described above, as shown in FIG. 23A, when the valves 5 are opened and closed by the minimum lift amount, the initial contact point position P of the swing arm 65 and the drive arm 70 is adjusted toward the leading edge side of the constant radius portion 72*a* by the control cam 123.

Figure 23B:
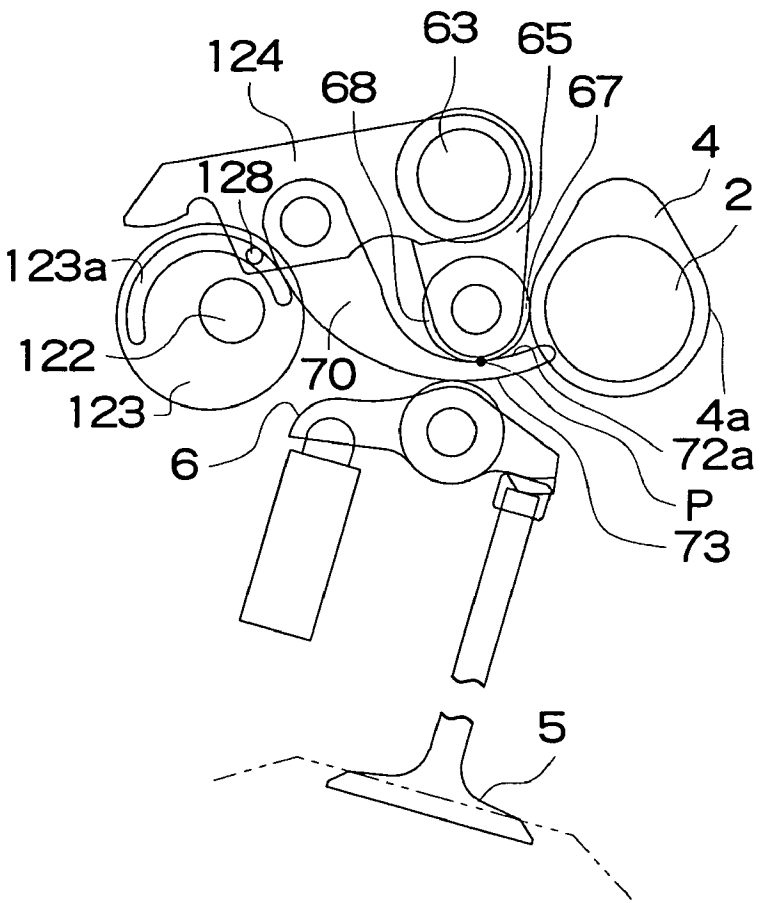
FIGS. 23A and 23B show structural diagrams of the variable valve mechanism of a seventh embodiment.
Figure 23A:
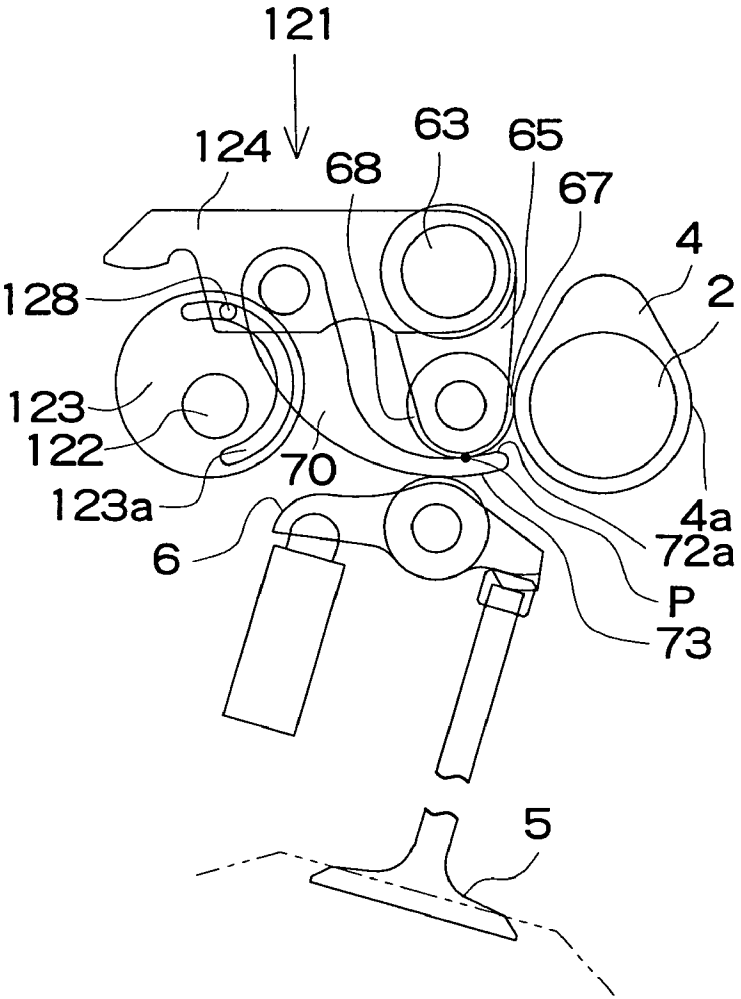

As shown in FIG. 23B, when the valves 5 are opened and closed by the maximum lift amount, the initial contact point position P of the swing arm 65 and the drive arm 70 is adjusted toward the trailing edge side of the constant radius portion 72*a* by the control cam 123.

Because the control shaft 122 is provided below the variable arms 124, the overall height of the engine can be significantly reduced and the engine can be made more compact overall.

EIGHTH EMBODIMENT

Figure 24B:
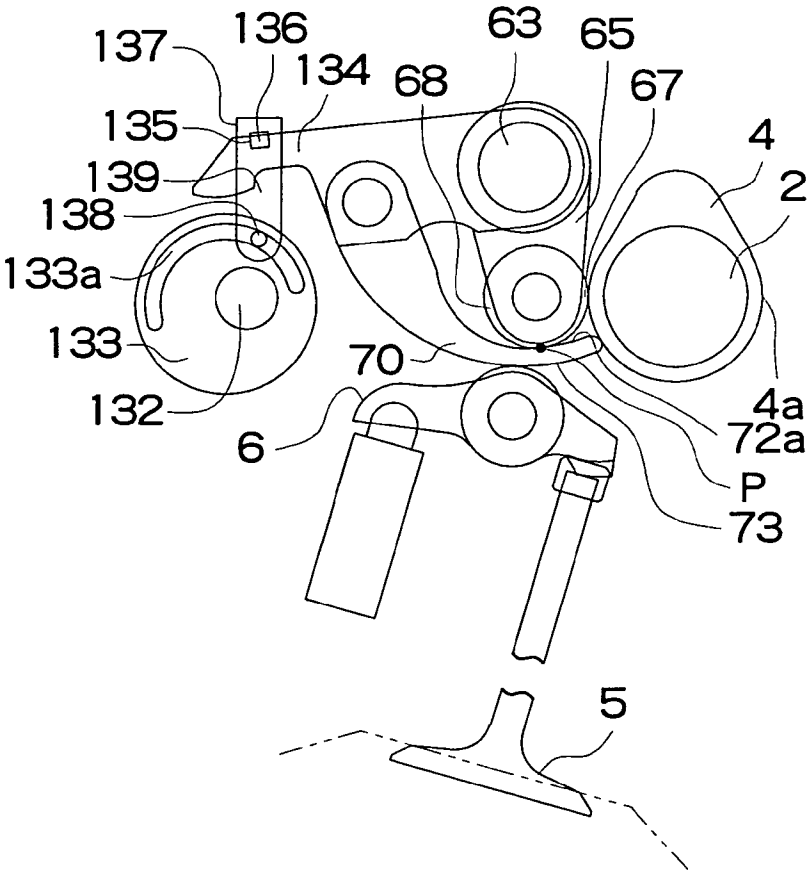
FIGS. 24A and 24B show structural diagrams of the variable valve mechanism of an eighth embodiment.
Figure 24A:
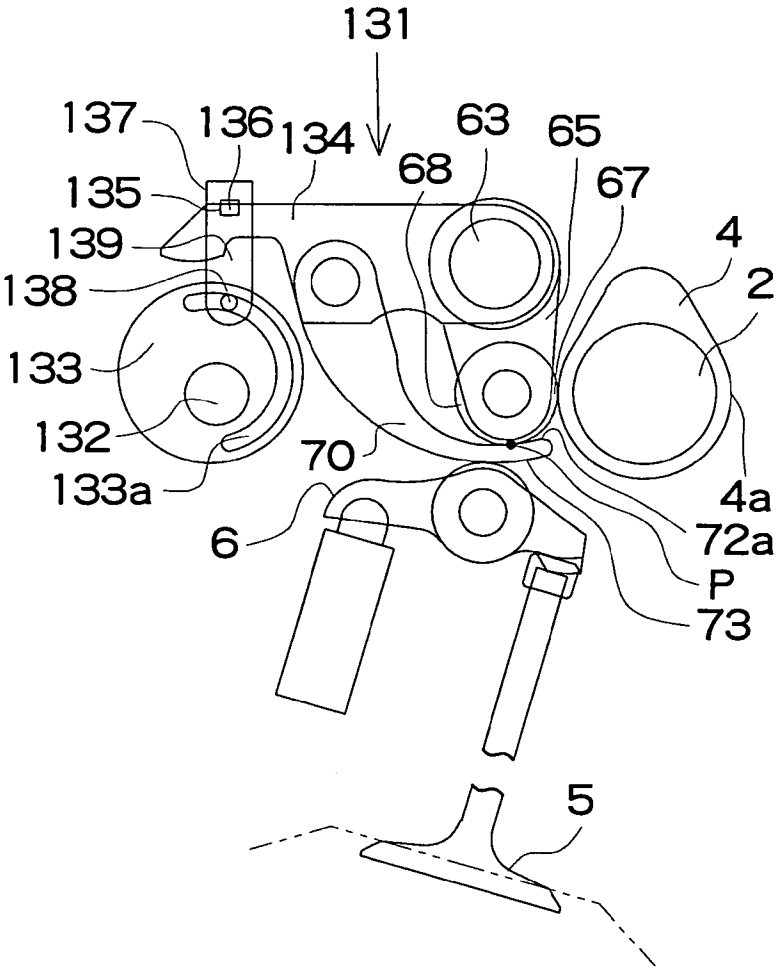
Figure 25:
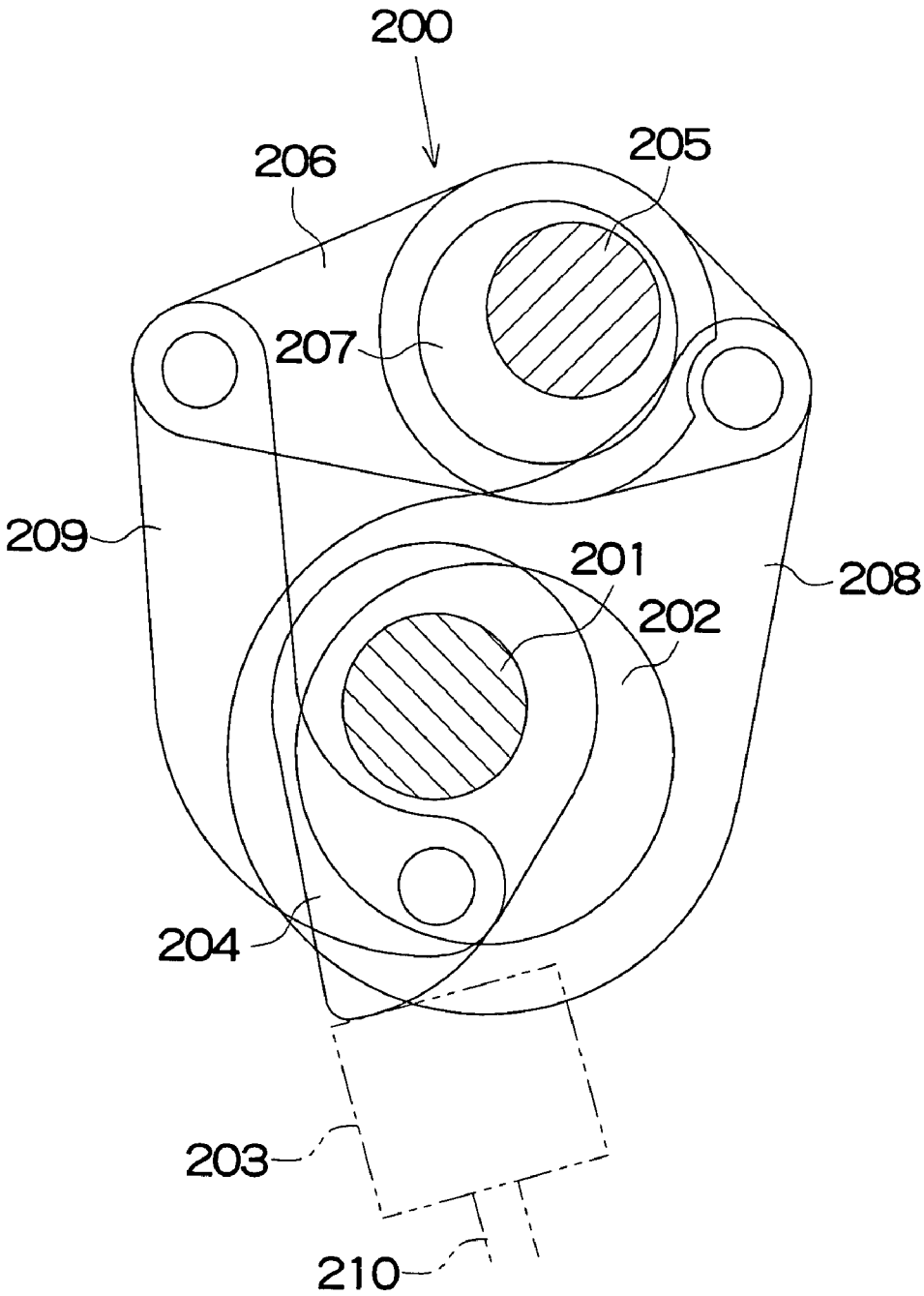
PRIOR ART FIG. 25
FIG. 25 is a cross-sectional view of a conventional variable valve mechanism.

An eighth embodiment of the present invention is shown in FIGS. 24A and 24B. This variable valve mechanism 131 differs from the seventh embodiment on the point that a shim 136 is interposed between a variable arm 134 and a control cam 133. A control shaft 132, which is parallel to the camshaft 2, is provided below the variable arms 134. On the control shaft 132, two control cams 133 that control the variable arms 134 are provided for each cylinder. The control cam 133 is provided with a cam groove 133*a* that is deflected from the shaft center of the control shaft 132, and is rotated integrally with the control shaft 132 by the actuator 11 (refer to FIG. 1). At the upper surface of the variable arm 134, a concave groove 135 is formed, and the shim 136 is placed in the concave groove 135 so as to be interposed between the variable arm 134 and a transfer member 137. On an ear portion 139 of the transfer member 137, a linking pin 138 engages the transfer member 137 and the control cam 133.

In the variable valve mechanism 131 having the structure described above, as shown in FIG. 24A, when the valves 5 are opened and closed by the minimum lift amount, the initial contact point position P of the swing arm 65 and the drive arm 70 is adjusted toward the leading edge side of the constant radius portion 72*a* by the control cam 133.

As shown in FIG. 24B, when the valves 5 are opened and closed by the maximum lift amount, the initial contact point position P of the swing arm 65 and the drive arm 70 is adjusted toward the trailing end side of the constant radius portion 72*a* by the control cam 133.

Because the control shaft 132 is provided below the variable arms 134, the overall height of the engine can be significantly reduced, and the engine can be made more compact overall.

Because the shim 136 is interposed between the variable arm 134 and the control cam 133 via the transfer member 137, by adjusting the shim 136, it is possible to finely adjust the positions of the variable arms 134 and the drive arms 70 with respect to the swing arm 65 simply. Thus, in a gasoline engine having a plurality of cylinders, without strictly managing the dimensional precision or the assembly precision of the valve train components, it is possible to control variation in the valve characteristics between cylinders simply, and thereby preferable effects related to fuel consumption, emissions, engine vibration, and the like can be anticipated.

Note that the present invention is not limited by the embodiments described above, and modifications within a range that does not depart from the spirit of the present invention are possible.

What is claimed is:

1. A variable valve mechanism, comprising:

a rotating cam that is provided on a camshaft;

a swing arm that contacts with the rotating cam to swing;

a drive arm that drives a valve in conjunction with the swing arm;

a variable arm that turns the drive arm around a swing axis of the swing arm;

an actuator that drives the variable arm; and a cam device that is provided between the swing arm and the drive arm;

wherein the variable arm is provided so as to be able to rotate relatively around the swing axis as the swing arm, wherein the cam device changes the initial position of the drive arm with respect to the swing arm accompanying the turning of the drive arm, wherein the variable arm and the swing arm are supported so as to be able to rotate relatively to each other on a support shaft, wherein a control shaft is separate from the support shaft and is linked to the actuator, wherein a control cam that drives the variable arm is provided on the control shaft, and wherein a shim is interposed between the control cam and the variable arm.

2. The variable valve mechanism according to claim 1, wherein a proximal end of the drive arm is linked to the variable arm, wherein a valve drive portion is provided on a distal end of the drive arm, and wherein the cam device is provided between a middle portion of the drive arm and the swing arm.

3. A variable valve mechanism, comprising:

a rotating cam that is provided on a camshaft;

a swing arm that contacts with the rotating cam to swing;

a drive arm that drives a valve in conjunction with the swing arm;

a variable arm that turns the drive arm around a swing axis of the swing arm;

an actuator that drives the variable arm; and a cam device that is provided between the swing arm and the drive arm, wherein the variable arm is provided so as to be able to rotate relatively around the swing axis of the swing arm, wherein the cam device changes the initial position of the drive arm with respect to the swing arm accompanying the turning of the drive arm, wherein the variable arm and the swing arm are supported so as to be able to rotate relatively to each other on a support shaft, wherein the control shaft is separate from the support shaft, is provided at one of a side of and below the variable arm, and is linked to the actuator, and wherein a control cam that drives the variable arm is provided on the control shaft.

4. The variable valve mechanism according to claim 3, wherein a proximal end of the drive arm is linked to the variable arm, wherein a valve drive portion is provided on a distal end of the drive arm, and wherein the cam device is provided between a middle portion of the drive arm and the swing arm.

5. The variable valve mechanism according to claim 3, further comprising:

a second variable arm that turns the drive arm around the swing axis of the swing arm, both of said variable arms provided on two vertical planes surrounding a vertical plane of the swing arm; and a shim interposed between said control shaft and both of said variable arms, wherein said both of said variable arms are provided so as to be able to rotate relatively around the swing axis of the swing arm, and wherein said actuator drives both of said variable arms.

6. The variable valve mechanism according to claim 5, wherein a proximal end of the drive arm is linked to distal ends of both of the variable arms, wherein the cam device is provided on a distal end of the drive arm, and wherein a valve drive portion is provided at a middle portion of the drive arm.

7. The variable valve mechanism according to claim 6, wherein the cam device comprises:

a cam surface for contacting a cam follower, said cam surface comprising:

a constant radius portion centered on an axis of the support shaft; and a lift portion projecting from the constant radius portion toward a side of the support shaft.

8. The variable valve mechanism according to claim 7, wherein the valve drive portion is formed such that it is included on a cylindrical surface that is concentric with the constant radius portion.

9. The variable valve mechanism according to claim 5, wherein both of the variable arms and the swing arm are supported so as to be able to rotate relatively to each other on a support shaft, wherein the support shaft, the control shaft, and the camshaft are supported in parallel, and wherein the control shaft comprises two control cams that drive both of the variable arms.

10. The variable valve mechanism according to claim 9, wherein the two control cams comprise control cam surfaces deflected from a center of the control shaft and rotated integrally with the control shaft by the actuator, wherein both of the variable arms comprise concave grooves formed on surfaces opposite to the control cam surfaces, and wherein the shim is placed in each of the concave grooves such that the shim is interposed between both of the variable arms and the two control cams.

11. The variable valve mechanism according to claim 5, wherein, at a center portion of both of the variable arms, a proximal end of the drive arm is linked such that it is able to swing vertically by a linking shaft.

12. The variable valve mechanism according to claim 5, wherein the control shaft is provided parallel to the camshaft and on sides of both of the variable arms, said control shaft comprising two control cams driving both of the variable arms and each having a cam surface, the cam surface deflected from a center of the control shaft and rotated integrally with the control shaft by the actuator, and wherein distal ends of both of the variable arms are provided opposite to the control shaft and include slanted surfaces that slant toward the distal ends, the slanted surfaces including concave grooves, the shim placed in each of the concave grooves such that the shim is interposed between both of the variable arms and the two control cams.

13. A variable valve mechanism, comprising:

a rotating cam that is provided on a camshaft;

a swing arm that contacts with the rotating cam to swing;

a drive arm that drives a valve in conjunction with the swing arm;

a variable arm that turns the drive arm around a swing axis of the swing arm;

an actuator that drives the variable arm; and a cam device that is provided between the swing arm and the drive arm, wherein the variable arm is provided so as to be able to rotate relatively around the swing axis of the swing arm, wherein the cam device changes the initial position of the drive arm with respect to the swing arm accompanying the turning of the drive arm, wherein the variable arm and the swing arm are supported so as to be able to rotate relatively to each other on a support shaft, wherein the control shaft is separate from the support shaft, is provided at one of a side of and and below the variable arm, and is linked to the actuator, wherein a control cam that drives the variable arm is provided on the control shaft, and wherein a shim is interposed between the control cam and the variable arm.

14. The variable valve mechanism according to claim 13, wherein a proximal end of the drive arm is linked to the variable arm, wherein a valve drive portion is provided on a distal end of the drive arm, and wherein the cam device is provided between a middle portion of the drive arm and the swing arm.

15. A variable valve mechanism, comprising:

a rotating cam that is provided on a camshaft;

a swing arm that contacts with the rotating cam to swing;

a drive arm that drives a valve in conjunction with the swing arm;

a variable arm that turns the drive arm around a swing axis of the swing arm, an actuator that drives the variable arm with a control shaft which is rotated by the actuator; and a cam device that is provided between the swing arm and the drive arm, wherein the variable arm is provided so as to be able to rotate relatively around the swing axis of the swing arm, wherein the cam device changes the initial position of the drive arm with respect to the swing arm accompanying the turning of the drive arm, and wherein the swing arm and the variable arm are supported by the control shaft.

16. The variable valve mechanism according to claim 15, wherein a proximal end of the drive arm is linked to the variable arm, wherein a valve drive portion is provided on a distal end of the drive arm, and wherein the cam device is provided between a middle portion of the drive arm and the swing arm.

* * * * *